US009638469B2

(12) United States Patent
Fujita et al.

(10) Patent No.: US 9,638,469 B2
(45) Date of Patent: May 2, 2017

(54) CONDENSER, MULTISTAGE PRESSURE CONDENSER PROVIDED THEREWITH, AND REHEATING MODULE USED IN CONDENSER

(71) Applicant: MITSUBISHI HITACHI POWER SYSTEMS, LTD., Kanagawa (JP)

(72) Inventors: Issaku Fujita, Tokyo (JP); Satoshi Hiraoka, Tokyo (JP); Kenji Kirihara, Tokyo (JP); Akira Fukui, Tokyo (JP); Kensuke Nishiura, Tokyo (JP); Taichi Nakamura, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 140 days.

(21) Appl. No.: 14/760,098

(22) PCT Filed: Feb. 13, 2014

(86) PCT No.: PCT/JP2014/053339

§ 371 (c)(1),
(2) Date: Jul. 9, 2015

(87) PCT Pub. No.: WO2014/126154

PCT Pub. Date: Aug. 21, 2014

(65) Prior Publication Data

US 2016/0010923 A1 Jan. 14, 2016

(30) Foreign Application Priority Data

Feb. 13, 2013 (JP) ..... 2013-026077

(51) Int. Cl.
*F22D 1/32* (2006.01)
*F28B 7/00* (2006.01)
(Continued)

(52) U.S. Cl.
CPC ..... *F28B 7/00* (2013.01); *F22D 1/32* (2013.01); *F28B 1/02* (2013.01); *F28B 3/02* (2013.01);
(Continued)

(58) Field of Classification Search
CPC ..... F22D 1/32; F28B 1/02; F28B 3/02; F28B 7/00; F28C 3/06; F28F 25/00; F28F 25/087
(Continued)

(56) References Cited

U.S. PATENT DOCUMENTS 3,575,392 A * 4/1971 Stoker ..... F28B 3/04 165/114
3,599,943 A 8/1971 Munters
(Continued)

FOREIGN PATENT DOCUMENTS

JP 47-36543 11/1972
JP 61-49230 4/1986
(Continued)

OTHER PUBLICATIONS

International Search Report issued May 20, 2014 in corresponding International Application No. PCT/JP2014/053339.
(Continued)

*Primary Examiner* — Charles Bushey
(74) *Attorney, Agent, or Firm* — Wenderoth, Lind & Ponack, L.L.P.

(57) ABSTRACT

This low-pressure condenser is provided with: a pressure bulkhead which partitions the inside of the container into an upper space and a lower space; a heat transfer tube which is arranged in the upper space; and a reheater which is arranged in the lower space and which, by means of high-temperature steam flowing from the outside into the lower space, heats water which condenses in the upper space and flows into the
(Continued)

lower space. The reheater includes multiple partition members, a receiving plate which receives water flowing downward via the partition members, and a dam which is connected to the outer peripheral edge of the receiving plate. The lower ends of the multiple partition members are below the upper end of the dam.

20 Claims, 16 Drawing Sheets

(51) Int. Cl.

| | |
|---|---|
| ***F28B 1/02*** | (2006.01) |
| ***F28B 3/02*** | (2006.01) |
| ***F28C 3/06*** | (2006.01) |
| ***F28F 25/08*** | (2006.01) |
| ***F28F 25/00*** | (2006.01) |

(52) U.S. Cl.
CPC ..... *F28C 3/06* (2013.01); *F28F 25/00* (2013.01); *F28F 25/087* (2013.01)

(58) Field of Classification Search
USPC ..... 261/146, 147, 151, 152, 153, 155, 261/DIG. 10, DIG. 76
See application file for complete search history.

(56) References Cited

U.S. PATENT DOCUMENTS

| | | | | |
|---|---|---|---|---|
| 3,911,067 | A * | 10/1975 | Chen | F28B 3/00 261/113 |
| 4,198,215 | A | 4/1980 | Regehr | |
| 6,814,345 | B2 * | 11/2004 | Inoue | F28B 1/02 261/113 |
| 7,111,832 | B2 * | 9/2006 | Inoue | F28B 1/02 261/113 |
| 8,360,402 | B2 * | 1/2013 | Sugitani | F01K 9/00 261/113 |
| 9,188,393 | B2 * | 11/2015 | Fujita | F28B 1/02 |
| 9,488,416 | B2 * | 11/2016 | Fujita | F01K 9/003 |

FOREIGN PATENT DOCUMENTS

| | | |
|---|---|---|
| JP | 6-118197 | 4/1994 |
| JP | 9-511322 | 11/1997 |
| JP | 2003-148876 | 5/2003 |
| JP | 3706571 | 10/2005 |
| JP | 2009-052867 | 3/2009 |
| JP | 2011-247454 | 12/2011 |
| JP | 2012-180956 | 9/2012 |
| JP | 2013-087971 | 5/2013 |
| WO | 2012/117597 | 9/2012 |
| WO | WO2013/080950 | 6/2013 |

OTHER PUBLICATIONS

Written Opinion of the International Searching Authority issued May 20, 2014 in corresponding International Application No. PCT/JP2014/053339.

Notice of Allowance issued Apr. 12, 2016 in corresponding Japanese Patent Application No. 2013-026077 (with English Translation).

First Office Action issued Jul. 15, 2016 in corresponding Chinese Application No. 201480004413.5 (with English translation).

* cited by examiner

CONDENSER, MULTISTAGE PRESSURE CONDENSER PROVIDED THEREWITH, AND REHEATING MODULE USED IN CONDENSER

TECHNICAL FIELD

The present invention relates to a condenser which returns steam to water, a multistage pressure condenser provided therewith, and a reheating module used in the condenser. Priority is claimed on Japanese Patent Application No. 2013-026077, filed Feb. 13, 2013, the content of which is incorporated herein by reference.

BACKGROUND ART

Some steam plants include a multistage condenser. In the multistage condenser, since cooling water inlet temperatures of condensers are different from each other, pressures of saturated steam generated in a process in which steam is returned to water by each condenser are different among the condensers. Accordingly, when two condensers are provided, one condenser is a high-pressure condenser, and the other condenser is a low-pressure condenser.

PTL 1 below discloses a multistage pressure condenser which includes a high-pressure condenser and a low-pressure condenser. The low-pressure condenser of the multistage pressure condenser includes a low-pressure condensate container into which low-pressure steam flows from the upper portion of the condenser, a pressure bulkhead which partitions the inside of the low-pressure condensate container into an upper space and a lower space, a heat transfer tube which is disposed in the upper space and condenses the low-pressure steam, and a tray which is disposed in the lower space. The low-pressure condenser and the high-pressure condenser are connected to each other by a steam duct through which a portion of high-pressure steam flowing into the high-pressure condenser is introduced into the lower space of the low-pressure condenser.

A plurality of through-holes which vertically penetrate are formed in the pressure bulkhead of the low-pressure condenser. Water which is condensed in the upper space flows down into the lower space through the plurality of through-holes of the pressure bulkhead. After the water is temporarily collected in the tray, the water overflows from the tray and is collected on a bottom in the lower space. While the water reaches the tray through the plurality of through-holes of the pressure bulkhead, and while the water overflows from the tray and reaches a water collection portion of the lower space, the water is subjected to high-temperature and high-pressure steam from the high-pressure condenser so as to be heated. In addition, when the water overflowing from the tray drops on the water collected on the bottom of the lower space, since a circulation flow is generated in the water collected on the bottom of the lower space, a contact ratio between the water and the high-temperature and high-pressure steam passing through the upper side of the water increases. Accordingly, with the technology disclosed in PTL 1, it is possible to increase the temperature of the water collected on the bottom of the lower space.

CITATION LIST

Patent Literature

[PTL 1] Japanese Patent No. 3706571

SUMMARY OF INVENTION

Technical Problem

In general, in a steam plant, water collected on the bottom of a condenser is introduced into a boiler via a condensate pump and a feed pump. The water introduced into the boiler becomes steam there, and after the steam is supplied to a steam turbine, the steam is returned to water by a condenser. Therefore, heat efficiency of the entire steam plant increases as temperature of the water collected on the bottom of the condenser increases. Accordingly, in the technology disclosed in PTL 1, as described above, the water collected on the bottom of the low-pressure condenser is heated by the high-temperature steam from the high-pressure condenser to increase the temperature of the water.

However, a demand for further increasing the heat efficiency of the entire steam plant always exists.

Therefore, an object of the present invention is to provide a condenser capable of increasing efficiency of reheating condensed water using high-temperature steam from outside in order to increase the heat efficiency of the entire steam plant, a multistage pressure condenser provided therewith, and a reheating module which is used in the condenser.

Solution to Problem

In order to achieve the object, according to an aspect of the present invention, there is provided a condenser including: a container into which steam flows; a pressure bulkhead which partitions the inside of the container into an upper space and a lower space and in which a plurality of bulkhead through-holes are formed; a heat transfer tube which is disposed in the upper space of the container, and condenses the steam which flows into the upper space; and a reheater which is disposed in the lower space of the container, and which heats water which is condensed from the steam in the upper space of the container and flows into the lower space of the container, by means of high-temperature steam which flows into the lower space from the outside of the container. The reheater includes a plurality of partition members which extend vertically in the lower space of the container and are arranged at intervals from each other, a receiving plate which receives water flowing downward via the plurality of partition members, and a dam which is connected to an outer peripheral edge of the receiving plate and surrounds the receiving plate, and lower ends of the plurality of partition members are below an upper end of the dam.

In a process in which water drops downward, the water comes into contact with the plurality of partition members. As a result, the surface area of the water increases. Accordingly, in the condenser, the contact ratio between the high-temperature steam passing through the portions between the plurality of partition members and the water increases.

After the water passing through the plurality of partition members is temporarily collected in a region surrounded by the receiving plate and the dam, the water overflows from the region and drops downward. In the condenser, since the lower ends of the plurality of partition members are below the upper end of the dam, the lower end portions of the plurality of partition members are submerged in the water collected in the region surrounded by the receiving plate and the dam. Accordingly, the high-temperature steam barely flows from the lower side of the plurality of partition members into the portions between the plurality of partition members. Accordingly, in the condenser, the flow velocity of the high-temperature steam passing through the portions between the plurality of partition members increases in a steam inflow direction perpendicular to a direction in which the plurality of partition members are arranged and a vertical direction.

In this way, in the condenser, since not only the contact ratio between the high-temperature steam and the water increases but also the flow velocity in the steam inflow direction of the high-temperature steam increases, the heat transfer coefficient between the high-temperature steam and the water increases. Therefore, according to the condenser, it is possible to effectively heat water by means of the high-temperature steam.

Here, in the condenser, a plurality of receiving plate through-holes may be formed in the receiving plate, and a plurality of dam through-holes may be also formed in the dam.

In both cases of where the plurality of receiving plate through-holes are formed in the receiving plate and where the plurality of dam through-holes are formed in the dam, since locations at which the water flows out from the region surrounded by the receiving plate and the dam are distributed, the contact ratio between the water and the high-pressure steam increases while the water drops and reaches a water collection portion. Accordingly, in the condenser, it is possible to increase efficiency of heating of the water by means of the high-pressure steam.

In any one of the above condensers, the repeater may include side plates which are disposed on both sides of a collection of the plurality of partition members in the direction in which the plurality of partition members are arranged, and oppose each other at intervals from the partition members.

When the side plates are not disposed on both sides of the collection of the plurality of partition members, the high-temperature steam from the arrangement direction may approach the partition members positioned on both ends in the arrangement direction. Accordingly, the flow velocity in the steam inflow direction of the high-temperature steam with respect to the partition members positioned on both ends in the arrangement direction decreases. Therefore, in the condenser, the side plates are disposed on both sides of the collection of the plurality of partition members, and thus, the approach of the high-temperature steam from the arrangement direction is prevented.

In any one of the above condensers, the repeater may include an upper end support member which supports each upper end portion of the plurality of partition members, and a lower end support member which supports each lower end portion of the plurality of partition members. In this case, an upper engagement portion, which is recessed from the lower side of the lower space of the container toward the upper side and into which each upper end portion of the plurality of partition members enters, may be formed on the upper end support member, and a lower engagement portion, which is recessed from the upper side of the lower space of the container toward the lower side and into which each lower end portion of the plurality of partition members enters, may be formed on the lower end support member. In a state where the partition member is elastically compressed vertically, the upper end portion of the partition member may enter into the upper engagement portion of the upper end support member, while the lower end portion of the partition member may enter into the lower engagement portion of the lower end support member, and the partition member may be interposed between the upper end support member and the lower end support member so as to be supported.

In addition, in any one of the above condensers, the partition member may include a corrugated plate in which convex portions protruding in the arrangement direction of the plurality of partition members and concave portions recessed in the arrangement direction are repeatedly formed vertically. Further, the partition member may include the corrugated plate, and a plurality of pocket forming members which are open toward the upper side and form pockets for collecting water in cooperation with the corrugated plate. In addition, a plurality of corrugated plate through-holes may be formed in the corrugated plate.

In addition, in any one of the above condensers, the reheater may include a reheating module, and the reheating module may include the plurality of partition members, the upper end support member, the lower end support member, the receiving plate, and the dam, and the reheating module may include a connection member which connects the receiving plate, the upper end support member, and the lower end support member with each other and integrates the plurality of partition members, the upper end support member, the lower end support member, the receiving plate, and the dam.

Thus, since at least a portion of the reheater is integrated, it is possible to increase installation workability of the reheater.

In addition, in the condenser including the reheating module, the reheating module may include a perforated plate which exists in a region vertically above the plurality of partition members and has a plurality of perforated plate through-holes which vertically penetrate. In this case, the perforated plate of the reheating module may constitute a portion of the pressure bulkhead.

In addition, in any one of the condensers including the reheating module, the reheater may include a plurality of the reheating modules.

By preparing the plurality of reheating modules in advance and combining the reheating modules appropriately, it is possible to easily apply the reheating modules to condensers having various sizes.

In addition, in the condenser including the plurality of reheating modules, the plurality of reheating modules may be adjacent to each other, and the reheater may include a water guide member which introduces water reaching a position between the plurality of reheating modules onto the partition member of any reheating module.

In the condenser, it is possible to decrease the amount of the water passing through the portions between the plurality of reheating modules.

In any one of the above condensers, the reheater may include a steam forcible introduction device which forcibly introduces the high-temperature steam into a portion between the plurality of partition members from one side in a steam inflow direction which is perpendicular to the arrangement direction of the plurality of partition members and the vertical direction.

In the condenser, since the flow rate of the high-temperature steam passing through the portions between the plurality of partition members increases, it is possible to effectively heat the water by means of the high-temperature steam.

In addition, in any one of the above condensers, the reheater may include a straightener which is disposed on one side in the steam inflow direction perpendicular to the arrangement direction of the plurality of partition members and the vertical direction based on the plurality of partition members, orients the flow direction of the high-temperature steam, which flows from the one side into the portions between the plurality of partition members, to the steam inflow direction, and uniformizes flow velocity distribution of the high-temperature steam in a plane perpendicular to the steam inflow direction.

In the condenser, it is possible to effectively perform heat exchange between the water and the high-temperature steam uniformly over the entirety of the plurality of partition members.

In order to achieve the object, according to another aspect of the present invention, there is provided a multistage pressure condenser including: a low-pressure condenser which is any one of the above condensers; a high pressure condenser in which a pressure of saturated steam generated in a process in which inflow steam is returned to water is higher than a pressure of saturated steam generated in a process in which inflow steam is returned to water in the low-pressure condenser; and a steam duct through which a portion of the steam flowing into the high-pressure condenser flows into the lower space of the low-pressure condenser.

In order to achieve the object, according to still another aspect of the present invention, there is provided a reheating module which heats water flowing from above by means of steam from outside, the reheating module including: a plurality of partition members which extend vertically and are arranged at intervals from each other; a receiving plate which receives water dropping via the plurality of partition members; a dam which is connected to an outer peripheral edge of the receiving plate and surrounds the receiving plate; an upper end support member which supports each upper end portion of the plurality of partition members; a lower end support member which supports each lower end portion of the plurality of partition members; and a connection member which connects the receiving plate, the upper end support member, and the lower end support member with each other and integrates the plurality of partition members, the receiving plate, the dam, the upper end support member, and the lower end support member. Lower ends of the plurality of partition members are below an upper end of the dam.

Similarly to the reheater, likewise in the reheating module, since not only the contact ratio between the high-temperature steam and the water increases but also the flow velocity in the steam inflow direction of the high-temperature steam increases, the heat transfer coefficient between the high-temperature steam and the water increases. Accordingly, likewise in the reheating module, it is possible to effectively heat the water by means of the high-temperature steam. In addition, it is possible to increase the installation workability of the reheater by using the reheating module.

In the reheating module, side plates which are disposed on both sides of a collection of the plurality of partition members in the direction in which the plurality of partition members are arranged, and oppose each other at intervals from the partition members may be included.

In any one of the above reheating modules, a perforated plate which covers a region vertically above the plurality of partition members and the upper end support member, and includes a plurality of vertically penetrating perforated plate through-holes may be included.

Advantageous Effects of Invention

According to an aspect of the present invention, it is possible to increase efficiency of reheating condensed water using high-temperature steam from outside.

DESCRIPTION OF EMBODIMENTS

Hereinafter, various embodiments of the present invention will be described with reference to the drawings.

Embodiments of Multistage Pressure Condenser

First, an embodiment of a multistage pressure condenser according to the present invention will be described with reference to FIGS. 1 to 5.

Figure 1:
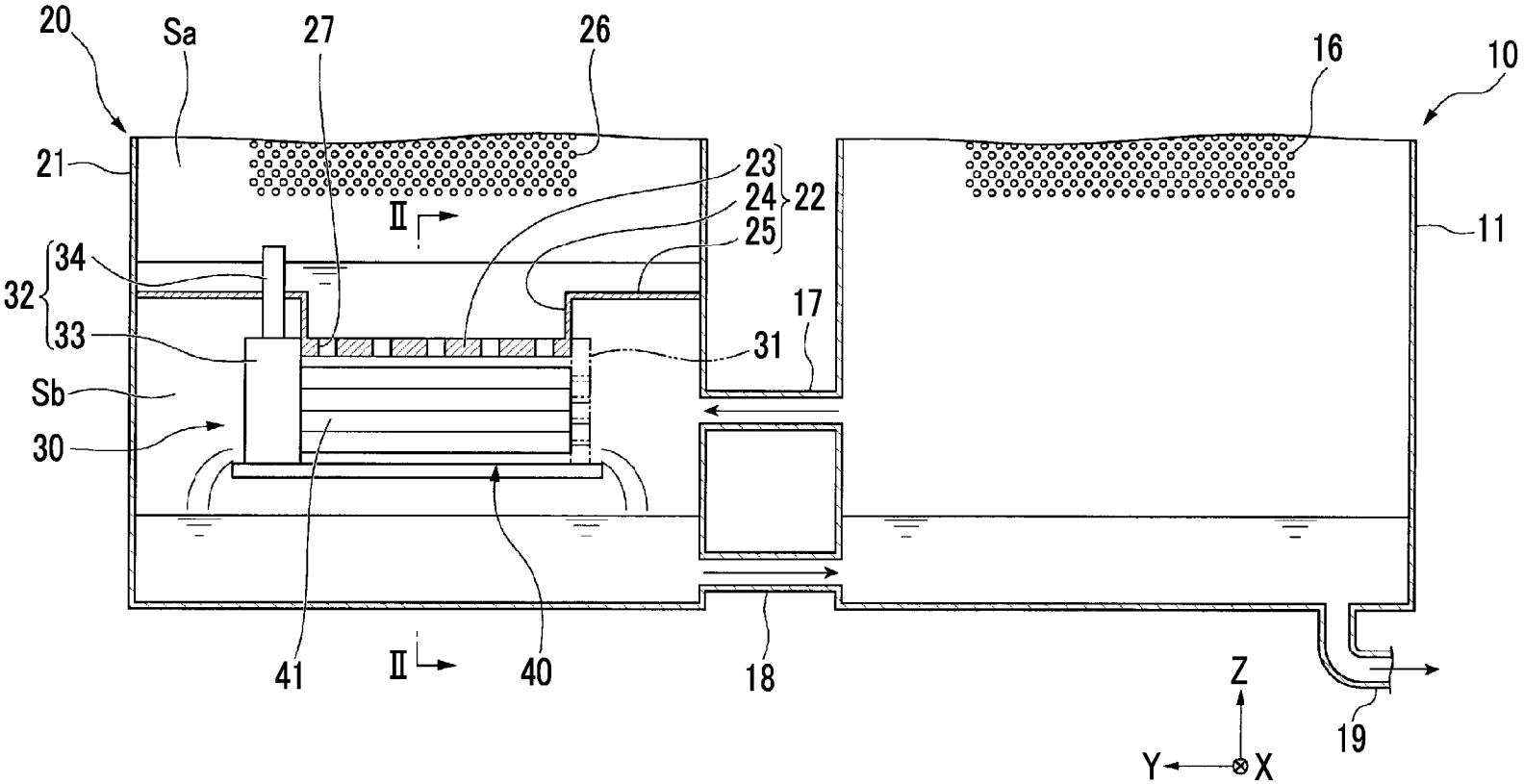
FIG. 1 is a main sectional view of a multistage pressure condenser according to an embodiment of the present invention.

As shown in FIG. 1, the multistage pressure condenser according to the present embodiment includes a high-pressure condenser 10, a low-pressure condenser 20, a steam duct 17 through which high-temperature and high-pressure saturated steam in the high-pressure condenser 10 is introduced into the low-pressure condenser 20, and a condensate flow pipe 18 through which water collected on the bottom of the low-pressure condenser 20 is introduced into the high-pressure condenser 10.

The multistage pressure condenser constitutes a portion of a steam plant. Although not illustrated, in addition to the multistage pressure condenser, the steam plant includes a boiler which generates steam, a steam turbine which is driven by the steam from the boiler and discharges the steam to the high-pressure condenser 10 and the low-pressure condenser 20 of the multistage pressure condenser, and a condensate pump and a feed pump for feeding the water from the multistage pressure condenser to the boiler.

The high-pressure condenser 10 includes a high-pressure condensate container 11 into which the steam flows from the steam turbine and heat transfer tubes 16 which are disposed in the high-pressure condensate container 11. Cooling water such as sea water is supplied to the heat transfer tubes 16. In the heat transfer tubes 16, heat exchange between the cooling water and the high-pressure steam is performed, and thus, the high-pressure steam is returned to water. The water is collected on the bottom of the high-pressure condensate container 11, and flows to the outside from a condensate discharge pipe 19 which is formed on the bottom of the high-pressure condensate container 11. In addition, a condensate pump is connected to the end portion of the condensate discharge pipe 19.

The low-pressure condenser 20 includes a low-pressure condensate container 21 into which the steam flows from the steam turbine, a pressure bulkhead 22 which partitions the low-pressure condensate container 21 into an upper space Sa and a lower space Sb, heat transfer tubes 26 which are disposed in the upper space Sa, and a repeater 30 which is disposed in the lower space Sb. Cooling water is supplied to the heat transfer tubes 26. In the heat transfer tubes 26, heat exchange between the cooling water and the low-pressure steam is performed, and thus, the low-pressure steam is returned to water. The temperature of the cooling water supplied to the heat transfer tubes 26 of the low-pressure condenser 20 is lower than the temperature of the cooling water supplied to the heat transfer tubes 16 of the high-pressure condenser 10. Accordingly, the pressure of saturated steam which is generated in a process in which the steam flowing into the low-pressure condenser 20 is returned to water in the low-pressure condenser 20 is lower than the pressure of saturated steam which is generated in a process in which the steam flowing into the high-pressure condenser 10 is returned to water in the high-pressure condenser 10.

The pressure bulkhead 22 includes a perforated plate 23 which is positioned at the center region of the low-pressure condensate container 21 in a plan view, a tubular partition side plate 24 which is formed along the outer edge of the perforated plate 23 and extends upward from the outer edge of the perforated plate 23, and a condensate receiving plate 25 which extends from the upper end of the partition side plate 24 to the outer peripheral side. A plurality of through-holes 27 (hereinafter, referred to as bulkhead through-holes 27) which vertically penetrate the perforated plate 23 are formed in the perforated plate 23. In addition, the condensate receiving plate 25 extends horizontally from the upper end of the partition side plate 24 to the inner peripheral surface of the low-pressure condensate container 21.

The lower space Sb side of the low-pressure condensate container 21 and the high-pressure condensate container 11 are connected to each other by the above-described steam duct 17. Accordingly, the inner portion of the high-pressure condensate container 11 and the lower space Sb of the low-pressure condensate container 21 communicate with each other via the steam duct 17. Moreover, the position of the bottom side of the high-pressure condensate container 11 and the position of the bottom side of the low-pressure condensate container 21 are connected to each other by the condensate flow pipe 18. Accordingly, the inner portion of the high-pressure condensate container 11 and the lower space Sb of the low-pressure condensate container 21 communicate with each other via the condensate flow pipe 18 as well.

The reheater 30 includes a reheating module 40 which is disposed vertically below the perforated plate 23 in the lower space Sb, a straightener 31 which is disposed on the steam duct 17 side of the reheating module 40, and a steam forcible introduction device 32 which is disposed on a side opposite to the steam duct 17 of the reheating module 40. Here, for convenience of explanation, a vertical direction is defined as a Z direction, a direction which is perpendicular to the Z direction and in which the straightener 31, the reheating module 40, and the steam forcible introduction device 32 are arranged is defined as a Y direction, and a direction which is perpendicular to the Z direction and the Y direction is defined as an X direction. In addition, in the Y direction, the straightener 31 side based on the reheating module 40 is defined as a steam upstream side, and the steam forcible introduction device 32 side based on the reheating module 40 is defined as a steam downstream side.

In the straightener 31, a plurality of plates extending in the Y direction are disposed in a lattice shape. The straightener 31 straightens the steam from the steam duct 17 positioned on the steam upstream side based on the straightener 31, and introduces the steam into the reheating module 40 disposed on the steam downstream side based on the straightener 31.

The steam forcible introduction device 32 forcibly introduces the high-pressure steam in the high-pressure condensate container 11 into the reheating module 40. The steam forcible introduction device 32 includes a buffer case 33 which covers the end portion of the reheating module 40 in the Y direction and a vent pipe 34 through which the inner portion of the buffer case 33 and the upper space Sa communicate with each other. The vent pipe penetrates the condensate receiving plate 25 of the pressure bulkhead 22.

Figure 2:
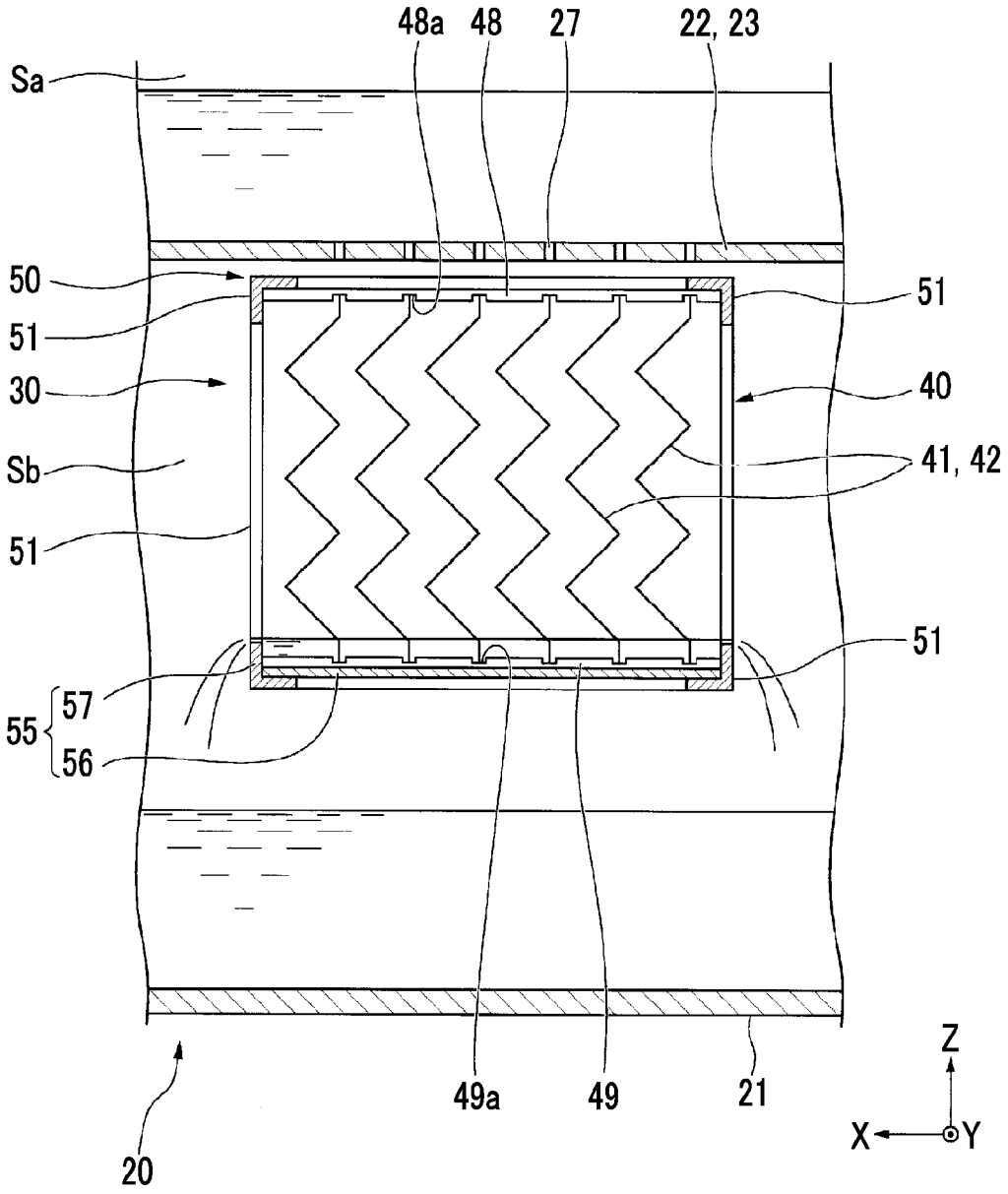
FIG. 2 is a sectional view taken along II-II of FIG. 1.
Figure 3:
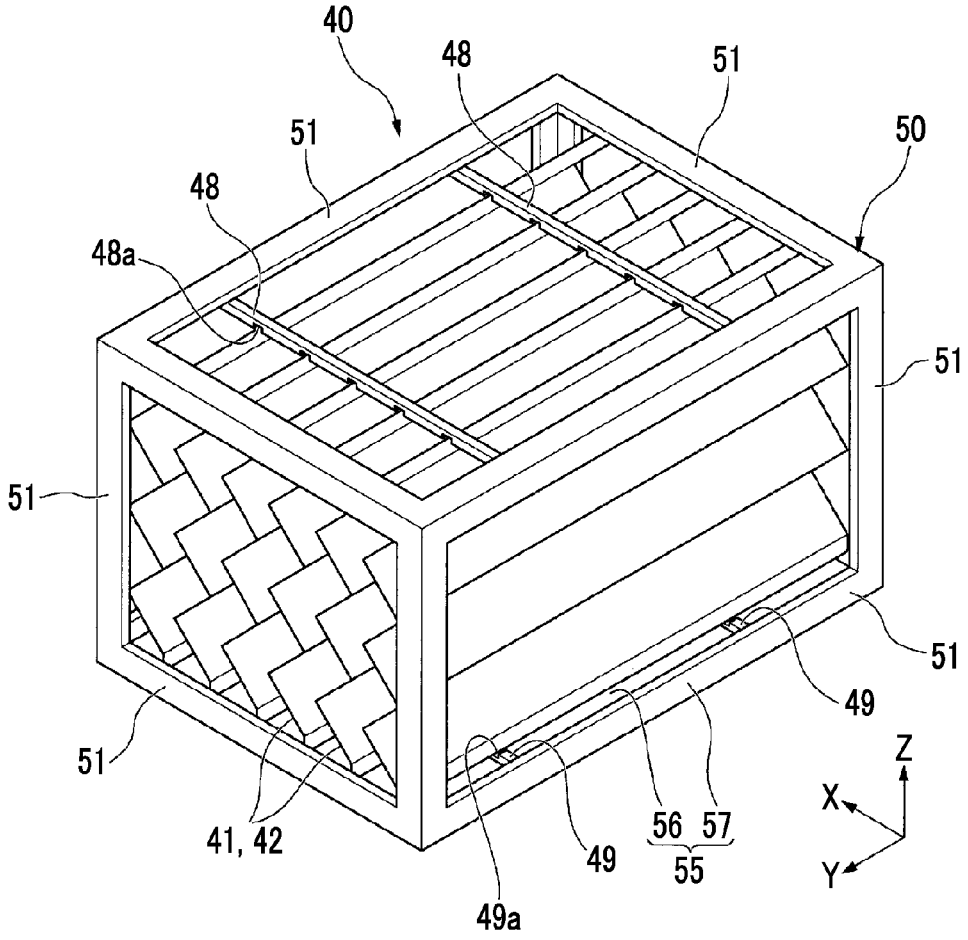
FIG. 3 is a perspective view showing a reheating module according to the embodiment of the present invention.
Figure 4:
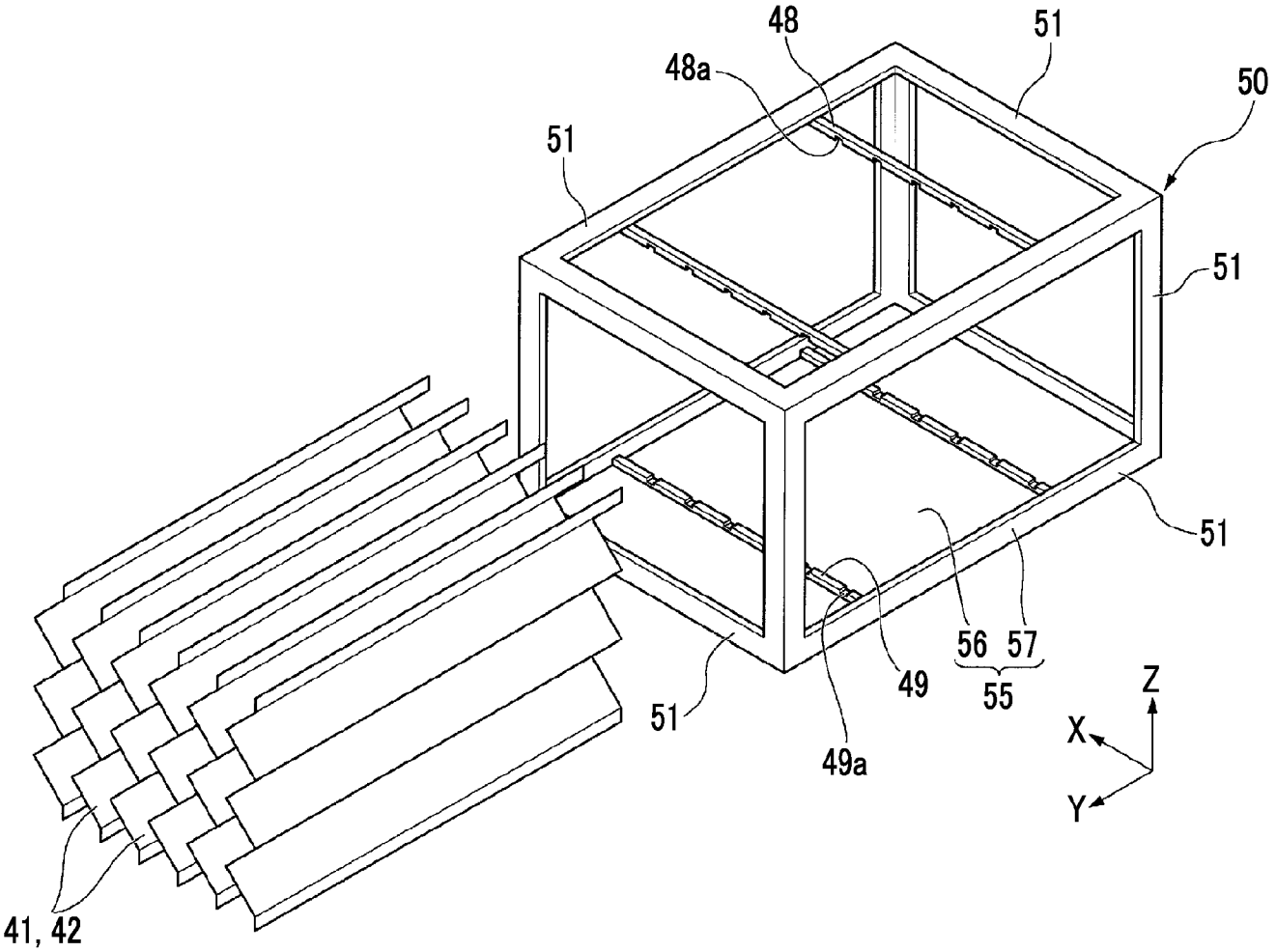
FIG. 4 is an exploded perspective view showing the reheating module according to the embodiment of the present invention.

As shown in FIGS. 2 to 4, the reheating module 40 includes a plurality of partition members 41 which extend in the Z direction and the Y direction and are arranged at intervals from each other in the X direction, a receiving plate 56 which receives water dropping via the plurality of partition members 41, an upper end support member 48 which supports each upper end portion of the plurality of partition members 41, a lower end support member 49 which supports each lower end portion of the plurality of partition members 41, and a frame 50 which surrounds the above-described components.

Figure 5:
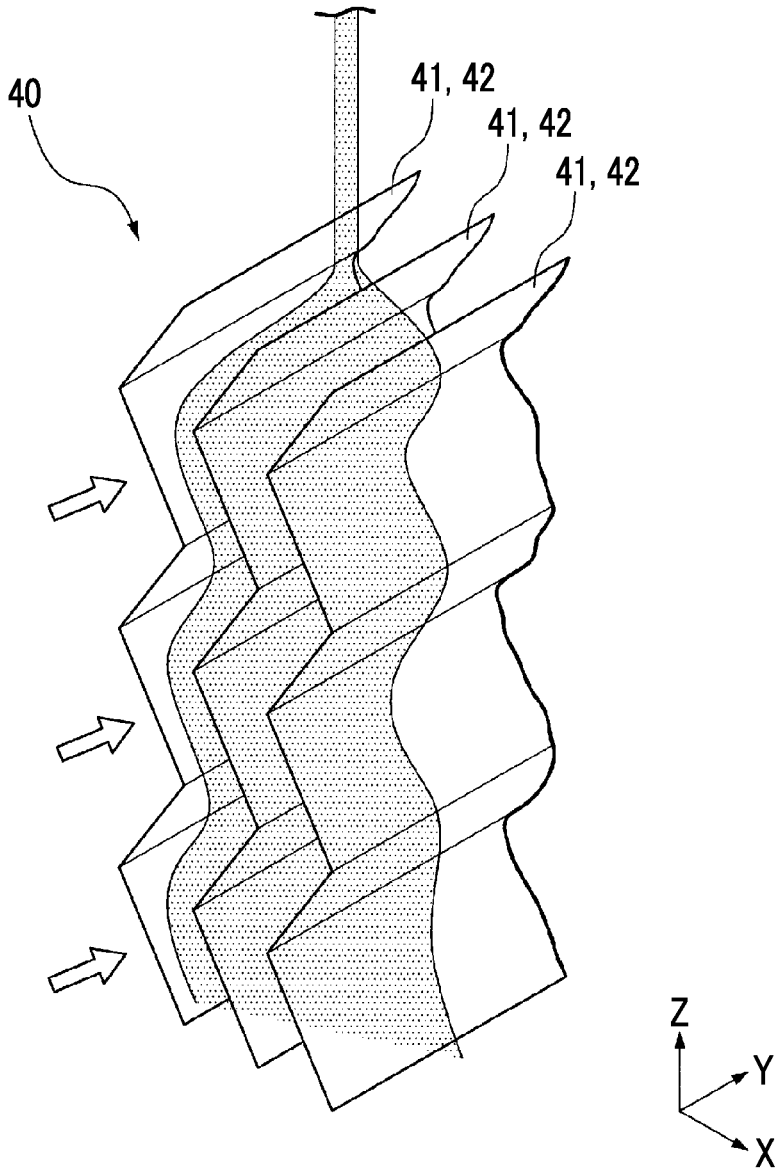
FIG. 5 is a main perspective view of partition members according to the embodiment of the present invention.

As shown in FIG. 5, the partition member 41 includes a corrugated plate 42 which is one rectangular plate processed so that convex portions protruding in the X direction and concave portions recessed in the X direction are repeated in the Z direction. For example, the corrugated plate 42 constituting the partition member 41 is formed of SUS 304 having a thickness of 3 mm. In the plurality of partition members 41, the positions of the upper ends, the lower ends, the convex portions, and the concave portions coincide with each other in the Z direction, and the plurality of partition members 41 are arranged at intervals from each other in the X direction. Accordingly, the plurality of partition members 41 form a rectangular parallelepiped shape as a whole.

As shown in FIGS. 2 to 4, the upper end support member 48 extends in the X direction in which the plurality of partition members 41 are arranged. In the upper end support member 48, an upper engagement portion 48*a* is formed, which is recessed from the lower side to the upper side and into which each upper end portion of the plurality of partition members 41 enters. In addition, the lower end support member 49 also extends in the X direction in which the plurality of partition members 41 are arranged. In the lower end support member 49, a lower engagement portion 49*a* is formed, which is recessed from the upper side to the lower side and into which each lower end portion of the plurality of partition members 41 enters.

The frame 50 includes twelve connection members 51 which are disposed along portions corresponding to the sides of the rectangular parallelepiped which is formed by the plurality of partition members 41. The connection member 51 is formed of an angle steel. End portions of the connection members 51 are joined to each other. The upper end support member 48 is laid between two connection members 51 which are positioned on the upper side and oppose each other in the X direction among the twelve connection members 51 configuring the frame 50, and is fixed to the two connection members 51. In addition, the lower end support member 49 is laid between two connection members 51 which are positioned on the lower side and oppose each other in the X direction among the twelve connection members 51 configuring the frame 50, and is fixed to the two connection members 51. In a state where the partition member 41 is elastically compressed in the vertical direction (Z direction), the upper end portion of the partition member 41 enters the upper engagement portion 48*a* of the upper end support member 48, while the lower end portion of the partition member 41 enters the lower engagement portion 49*a* of the lower end support member 49, and the partition member 41 is interposed and supported between the upper end support member 48 and the lower end support member 49.

The receiving plate 56 is formed in a rectangular shape, and is joined to four connection members 51 on the lower side so as to close a rectangular opening formed by the four lower connection members 51 among the twelve connection members 51 configuring the frame 50. Of the two sides of the angle steels, which are the four connection members 51, one side extends in the horizontal direction, and the other side extends upward from the end portion of the one side. The sides extending upward of the angle steels, which are the four connection members 51, are connected to the outer peripheral edge of the receiving plate 56 and form a dam 57 surrounding the receiving plate 56. In the reheating module 40, a tray 55 is formed by the receiving plate 56 and the dam 57 which is connected to the outer peripheral edge of the receiving plate 56 and surrounds the receiving plate 56.

The receiving plate 56, the upper end support member 48, and the lower end support member 49 are connected to each other by the plurality of connection members 51 configuring the frame 50. As a result, in the reheating module 40, the plurality of partition members 41, the receiving plate 56, the dam 57, the upper end support member 48, and the lower end support member 49 are integrated.

As shown in FIG. 2, in the reheating module 40, the lower ends of the plurality of partition members 41 are below the upper end of the dam 57. Accordingly, in a state where water overflows from the tray 55, the lower ends of the plurality of partition members 41 securely sink in water collected in the tray 55.

The above-described reheating module 40 is disposed in a state of being suspended in the lower space Sb at a position vertically below the perforated plate 23. Accordingly, for example, the reheating module 40 is supported by a leg member or supported by a suspending member fixed to the pressure bulkhead 22.

Next, an operation of the multistage pressure condenser, of which the configuration has been described, will be described.

The steam discharged from the steam turbine flows into the high-pressure condensate container 11. The steam is heat-exchanged with the cooling water flowing in the heat transfer tubes 16 disposed in the high-pressure condensate container 11 and is cooled so as to be condensed, and thus, the steam is returned to water (hereinafter, referred to as a high-pressure side condensate). The high-pressure side condensate is temporarily collected on the bottom of the high-pressure condensate container 11, and is discharged to the outside via the condensate discharge pipe 19. As described above, the high-pressure side condensate is returned to the boiler by the condensate pump and the feed pump.

In addition, steam which is discharged from the steam turbine also flows into the upper space Sa of the low-pressure condensate container 21. The steam is heat-exchanged with the water flowing in the heat transfer tubes 26 disposed in the upper space Sa and is cooled so as to be condensed, and thus, the steam is returned to water (hereinafter, referred to as a low-pressure side condensate). Here, as described above, the temperature of the cooling water supplied to the heat transfer tubes 26 of the low-pressure condenser 20 is lower than the temperature of the cooling water supplied to the heat transfer tubes 16 of the high-pressure condenser 10. Accordingly, the pressure of the saturated steam generated in a process in which the steam flowing into the upper space Sa of the low-pressure condenser 20 is returned to the water in the upper space Sa is lower than the pressure of the saturated steam generated in a process in which the steam flowing into the high-pressure condensate container is returned to the water in the high-pressure condensate container 11. Therefore, the pressure of the upper space Sa in the low-pressure condenser 20 is lower than the pressure in the high-pressure condensate container 11. The low-pressure side condensate is temporarily collected on the pressure bulkhead 22 in the upper space Sa. The low-pressure side condensate collected on the pressure bulkhead 22 passes through the plurality of bulkhead through-holes 27 formed in the perforated plate 23 of the pressure bulkhead 22, and flows downward into the lower space Sb.

As shown in FIG. 5, the low-pressure side condensate passing through the bulkhead through-holes 27 of the perforated plate 23 flows downward along the surfaces of corrugated plates 42, which form the partition members 41 of the reheating module 40, while turning into a thin film, and thus, the surface area of the low-pressure condensate increases. As shown in FIG. 2, the low-pressure side condensate flowing downward along the corrugated plate 42 is temporarily collected in the tray 55 which is disposed below the corrugated plate 42. Then, the low-pressure side condensate overflows from the tray 55, and is temporarily collected on the bottom of the low-pressure condensate container 21. As shown in FIG. 1, the low-pressure side condensate collected on the bottom of the low-pressure condensate container 21 flows into the bottom of the high-pressure condensate container 11 via the condensate flow pipe 18, and is returned to the boiler by the condensate pump and the feed pump along with the high-pressure side condensate.

As described above, the pressure in the upper space Sa of the low-pressure condensate container 21 is lower than the pressure in the high-pressure condensate container 11. In addition, the pressure in the lower space Sb of the low-pressure condensate container 21 into which the low-pressure side condensate flows is higher than the pressure in the upper space Sa, and is lower than the pressure in the high-pressure condensate container 11. That is, among the pressure in the high-pressure condensate container 11, the pressure in the lower space Sb of the low-pressure condensate container 21, and the pressure in the upper space Sa of the low-pressure condensate container 21, the pressure in the high-pressure condensate container 11 is the highest, the pressure in the lower space Sb of the low-pressure condensate container 21 is the next highest, and the pressure in the upper space Sa of the low-pressure condensate container 21 is the lowest.

Accordingly, a portion of the high-pressure steam in the high-pressure condensate container 11 flows into the lower space Sb of the low-pressure condensate container 21 via the steam duct 17. In addition, the steam downstream side of the reheating module 40 communicates with the upper space Sa of the low-pressure condensate container 21 by means of the steam forcible introduction device 32. Accordingly, the high-pressure steam flowing into the lower space Sb flows into the upper space Sa of the low-pressure condensate container 21 via the straightener 31, the reheating module 40, and the steam forcible introduction device 32. In other words, the high-pressure steam flowing into the lower space Sb of the low-pressure condensate container 21 from the high-pressure condensate container 11 is forcibly introduced into the reheating module 40. Accordingly, compared to a case where the steam forcible introduction device 32 is not provided, the flow rate of the high-pressure steam introduced into the reheating module 40 increases.

The high-pressure steam passes through the straightener 31 before it is introduced into the reheating module 40. In a process in which the high-pressure steam passes through the straightener 31, the flow direction of the steam is adjusted to the Y direction (steam inflow direction), and a flow velocity of the steam in a plane perpendicular to the Y direction, that is, a flow velocity of the steam on a ZX plane is uniformized.

After the high-pressure steam straightened by the straightener 31 passes through the portions between the plurality of partition members 41 of the reheating module 40, the steam flows into the upper space Sa of the low-pressure condensate container 21 via the steam forcible introduction device 32. As described above, the low-pressure side condensate flows downward over the surfaces of the corrugated plates 42 which are the partition members 41. In the process in which the low-pressure side condensate flows downward along the surfaces of the corrugated plates 42, the low-pressure side condensate is turned into a thin film and the surface area enlarges, so that a contact ratio per unit volume between the low-pressure side condensate and the high-pressure steam increases. In addition, as described above, since the flow rate of the high-pressure steam introduced into the reheating module 40 increases, the flow velocity of the high-pressure steam passing through the plurality of partition members 41 increases. In addition, since the lower end portions of the plurality of partition members are submerged in the low-pressure side condensate collected in the tray 55, the high-pressure steam does not flow into the portions between the plurality of partition members 41 from the lower side of the plurality of partition members 41, and most high-pressure steam flows into the portions between the plurality of partition members 41 from the straightener 31 side. Accordingly, the flow velocity of the high-pressure steam in the steam inflow direction (Y direction) between the plurality of partition members 41 increases. Therefore, the heat transfer coefficient between the thin-film low-pressure side condensate and the high-pressure steam increases, and the low-pressure side condensate is effectively heated by the high-pressure steam.

While the low-pressure side condensate overflowing from the tray 55 reaches the water collection portion of the lower space Sb, the low-pressure side condensate is subjected to the high-temperature and high-pressure steam and is heated. Moreover, if the low-pressure side condensate overflowing from the tray 55 drops into the low-pressure side condensate collected on the bottom of the lower space Sb, since circulation flows are generated in the low-pressure side condensate collected on the bottom of the lower space Sb, the contact ratio between the low-pressure side condensate and the high-temperature and high-pressure steam passing through above the low-pressure side condensate increases, and the low-pressure side condensate is further heated.

As described above, in the present embodiment, the heat transfer coefficient between the low-pressure side condensate and the high-temperature and high-pressure steam increases, so that the low-pressure side condensate is highly effectively heated by the high-temperature and high-pressure steam. In this way, as described above, the heated low-pressure side condensate flows to the bottom of the high-pressure condensate container 11 via the condensate flow pipe 18 and is returned to the boiler along with the high-pressure side condensate by the condensate pump and the feed pump. Accordingly, in the present embodiment, since it is possible to supply high-temperature water to the boiler, it is possible to increase the heat efficiency of the steam plant.

First Modification Example of Reheater

Figure 6:
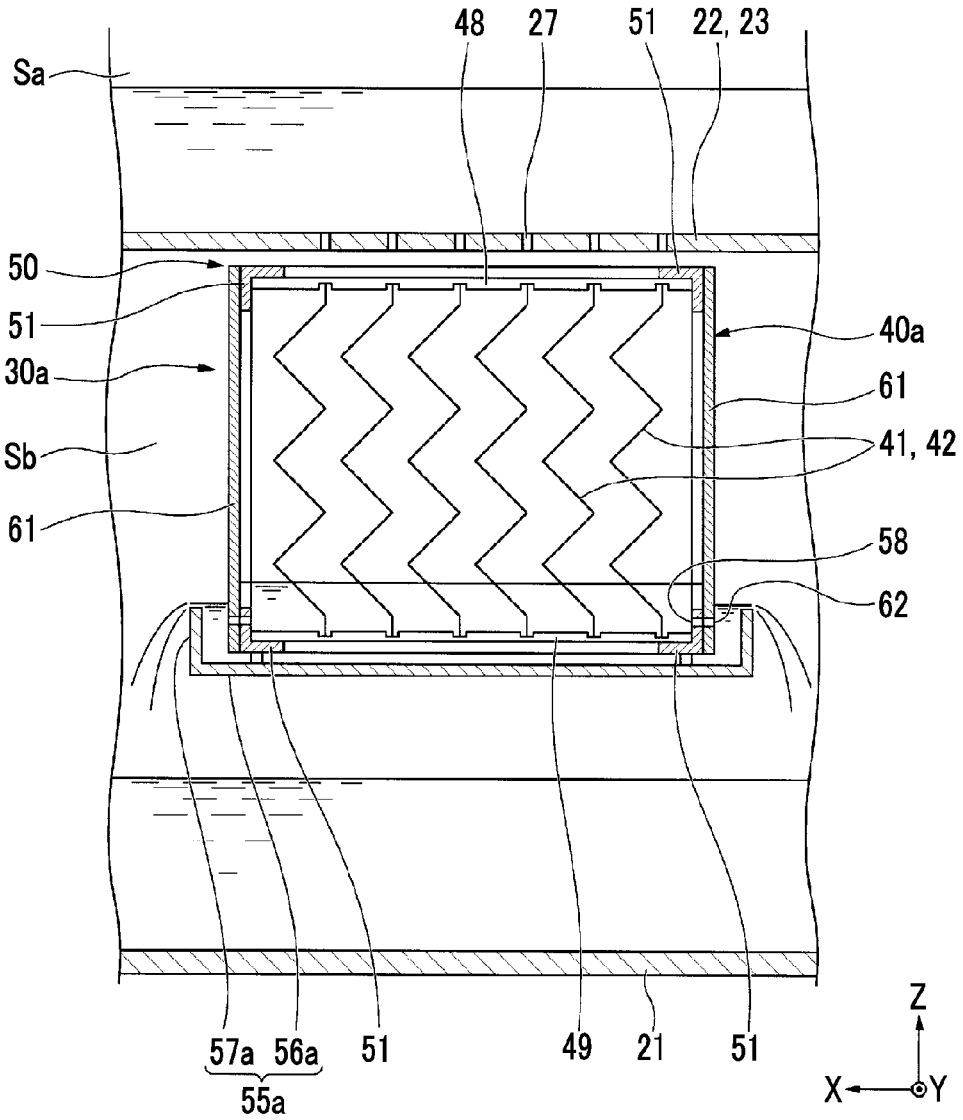
FIG. 6 is a main sectional view of a low-pressure condenser including a reheater according to a first modification example of the present invention.

Next, a first modification example of the reheater will be described with reference to FIG. 6.

In a reheating module 40*a* of a reheater 30*a* of the present modification example, side plates 61 are provided on the side surfaces of the frame 50 covering the plurality of partition members 41, and a tray 55*a* is provided below the frame 50.

As the side plates 61, there are the side plate 61 which covers a rectangular opening formed by four connection members 51 on one side in the X direction among the twelve connection members 51 configuring the frame 50, and the side plate 61 which covers a rectangular opening formed by four connection members 51 on the other side in the X direction. Each of the side plates 61 is joined to the connection members 51.

A plurality of through-holes 58 are formed in two connection members 51 which are disposed at the lower side and oppose each other in the X direction among the twelve connection members 51 configuring the frame 50. More specifically, the through-holes 58 penetrating in the X direction are formed in the sides extending to the upper side of the angle steels configuring the connection members 51. Through-holes 62 which penetrate in the X direction and communicate with the through-holes 58 of the connection members 51 are formed in the side plates 61.

Similarly to the tray 55 of the above-described embodiment, the tray 55*a* is configured to include a receiving plate 56*a* and a dam 57*a* which is connected to the outer peripheral edges of the receiving plate 56*a* and surrounds the receiving plate 56*a*. However, unlike the tray 55 of the above-described embodiment, in the tray 55*a* of the present modification example, the receiving plate 56*a* is disposed below the frame 50, and the dam 57*a* is disposed on the outside of the frame 50 in the X direction and the Y direction. However, likewise in the present modification example, the lower ends of the plurality of partition members 41 are positioned below the upper end of the dam 57*a*.

In the reheater 30 of the above-described embodiment, among the plurality of partition members 41 which are arranged in the X direction, the high-pressure steam in the X direction may approach the partition members 41 positioned on both ends in the X direction. Accordingly, the flow velocity in the steam inflow direction (Y direction) of the high-pressure steam with respect to the partition members 41 positioned on both ends in the X direction is lower than the flow velocity in the steam inflow direction of the high-pressure steam between the plurality of partition members 41. Therefore, in the present modification example, the side plates 61 are provided on the frame 50 so that the flow velocity in the steam inflow direction of the high-pressure steam with respect to the partition members 41 positioned on both ends in the X direction is the same as the flow velocity in the steam inflow direction of the high-pressure steam between the plurality of partition members 41, and thus, the approach of the high-pressure steam in the X direction with respect to the partition members is prevented.

However, if the side plates 61 are provided on the frame 50, the low-pressure side condensate collected in the tray 55*a* cannot flow out from the X direction sides on which the side plates 61 are provided, and flows out from only the Y direction sides. In this way, if the low-pressure side condensate can flow out only in a specific direction, the contact ratio between the low-pressure side condensate and the high-pressure steam decreases until the low-pressure side condensate reaches the water collection portion of the lower space Sb. In addition, since the circulation flows, which are formed when the low-pressure side condensate drops into the low-pressure side condensate collected on the bottom of the lower space Sb, are unevenly distributed, the contact ratio between the low-pressure side condensate collected on the bottom of the lower space Sb and the high-temperature and high-pressure steam passing through above the low-pressure side condensate also decreases. Accordingly, efficiency of heating the low-pressure side condensate by means of the high-pressure steam decreases.

Accordingly, in the present modification example, the through-holes 58 and 62 penetrating in the X direction are formed in the connection members 51 disposed on the lower side and the side plates 61, and thus, the low-pressure side condensate can also flow out in the X direction from the side plates 61. In addition, in the present modification example, in order to ensure that the liquid level of the low-pressure side condensate collected on the lower side of the plurality of partition members 41 is above the lower ends of the plurality of partition members 41, the dam 57*a* of the tray 55*a* is positioned on the outside in the X direction and the Y direction with respect to the frame 50, and the lower ends of the plurality of partition members 41 are positioned below the upper end of the dam 57*a*.

Second Modification Example of Reheater

Figure 7:
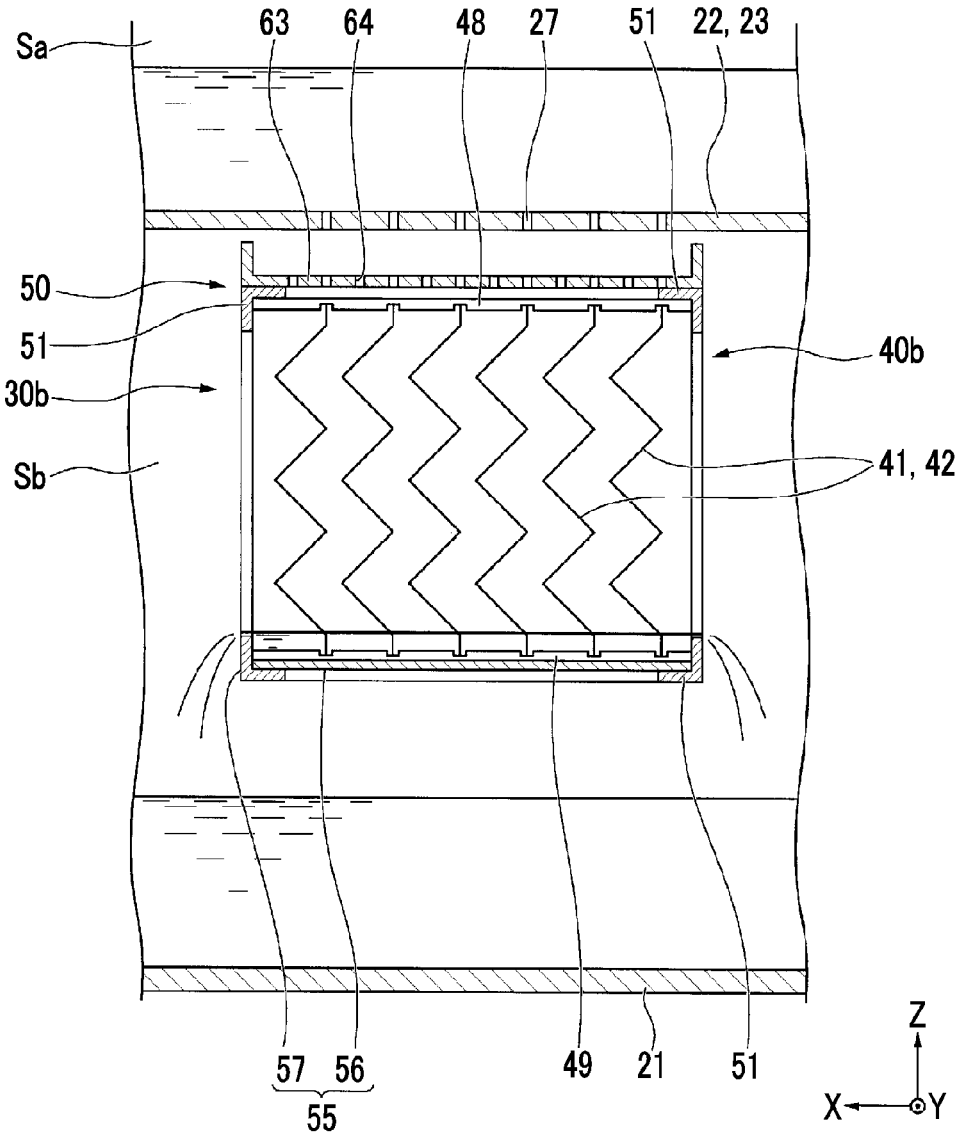
FIG. 7 is a main sectional view of a low-pressure condenser including a reheater according to a second modification example of the present invention.

Next, a second modification example of the reheater will be described with reference to FIG. 7.

In a reheating module 40*b* of a reheater 30*b* of the present modification example, the perforated plate 63 is provided on the upper portion of the reheating module 40 of the above-described embodiment. A plurality of through-holes 64 (perforated plate through-holes 64) penetrating in the vertical direction (Z direction) are formed in the perforated plate 63. The perforated plate 63 is joined to the upper portion of the frame 50 of the reheating module 40*b* of the present modification example.

In the present modification example, the high-pressure steam does not flow into the portions between the plurality of partition members 41 from the upper side of the plurality of partition members 41, and most high-pressure steam flows in from the straightener 31 (shown in FIG. 1) side. Accordingly, in the present modification example, the flow velocity of the high-pressure steam in the steam inflow direction (Y direction) between the plurality of partition members 41 is higher than that of the above-described embodiment, and it is possible to further increase the efficiency of heating the low-pressure side condensate by means of the high-pressure steam.

Moreover, as described above, in the present modification example, the perforated plate 63 is provided on the upper portion of the reheating module 40 of the above-described embodiment. However, the perforated plate 63 may be provided on the upper portion of the reheating module 40*a* of the first modification example.

Third Modification Example of Reheater

Figure 8:
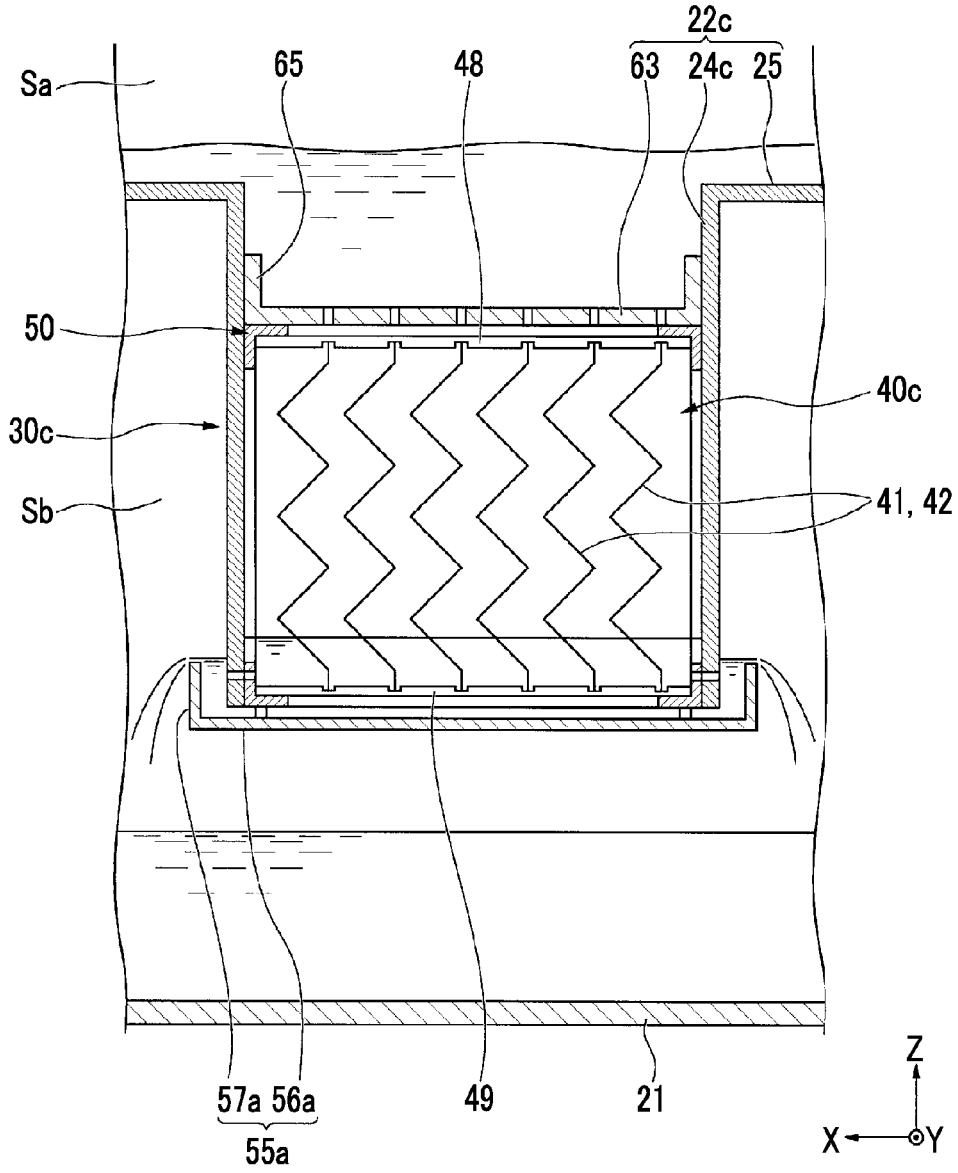
FIG. 8 is a main sectional view of a low-pressure condenser including a reheater according to a third modification example of the present invention.

Next, a third modification example of the reheater will be described with reference to FIG. 8.

In a reheating module 40*c* of a reheater 30*c* of the present modification example, the perforated plate 63 is provided on the upper portion of the reheating module 40*a* of the first modification example. In addition, in the reheater 30*c* of the present modification example, partition side plates 24*c* of a pressure bulkhead 22*c* in the low-pressure condenser 20 take on the function of the side plate 61 of the reheating module 40*a* in the first modification example.

In the present modification example, each of the partition side plates 24*c* of the pressure bulkhead 22*c* extends to the lower end of the frame 50 along the frame 50 of the reheating module 40*c*.

A flanged portion 65 opposing the partition side plate 24*c* is formed on the outer peripheral edge of the perforated plate 63 of the reheating module 40*c*. The perforated plate 63 is joined to the frame 50 of the reheating module 40*c*, and in a process in which the reheating module 40*c* is installed, the flanged portion 65 of the perforated plate 63 is joined to the partition side plate 24*c* and constitutes a portion of the pressure bulkhead 22*c* of the low-pressure condenser.

In the present modification example, since the high-pressure steam does not flow from the upper side and the lower side of the plurality of partition members 41, and does not flow in the X direction, the flow velocity of the high-pressure steam in the steam inflow direction (Y direction) between the plurality of partition members 41 is higher than that of the above-described embodiment and the first and second modification examples, and thus, it is possible to further increase the efficiency of heating the low-pressure side condensate by means of the high-pressure steam.

Fourth Modification Example of Reheater

Figure 9:
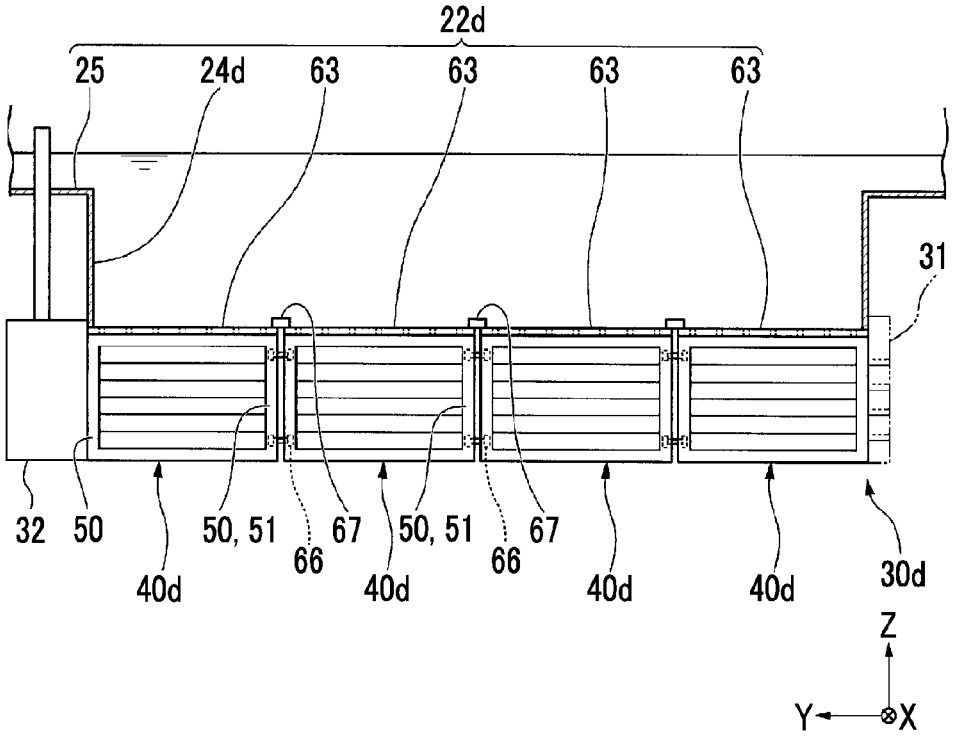
FIG. 9 is a main sectional view of a low-pressure condenser including a reheater according to a fourth modification example of the present invention.
Figure 10:
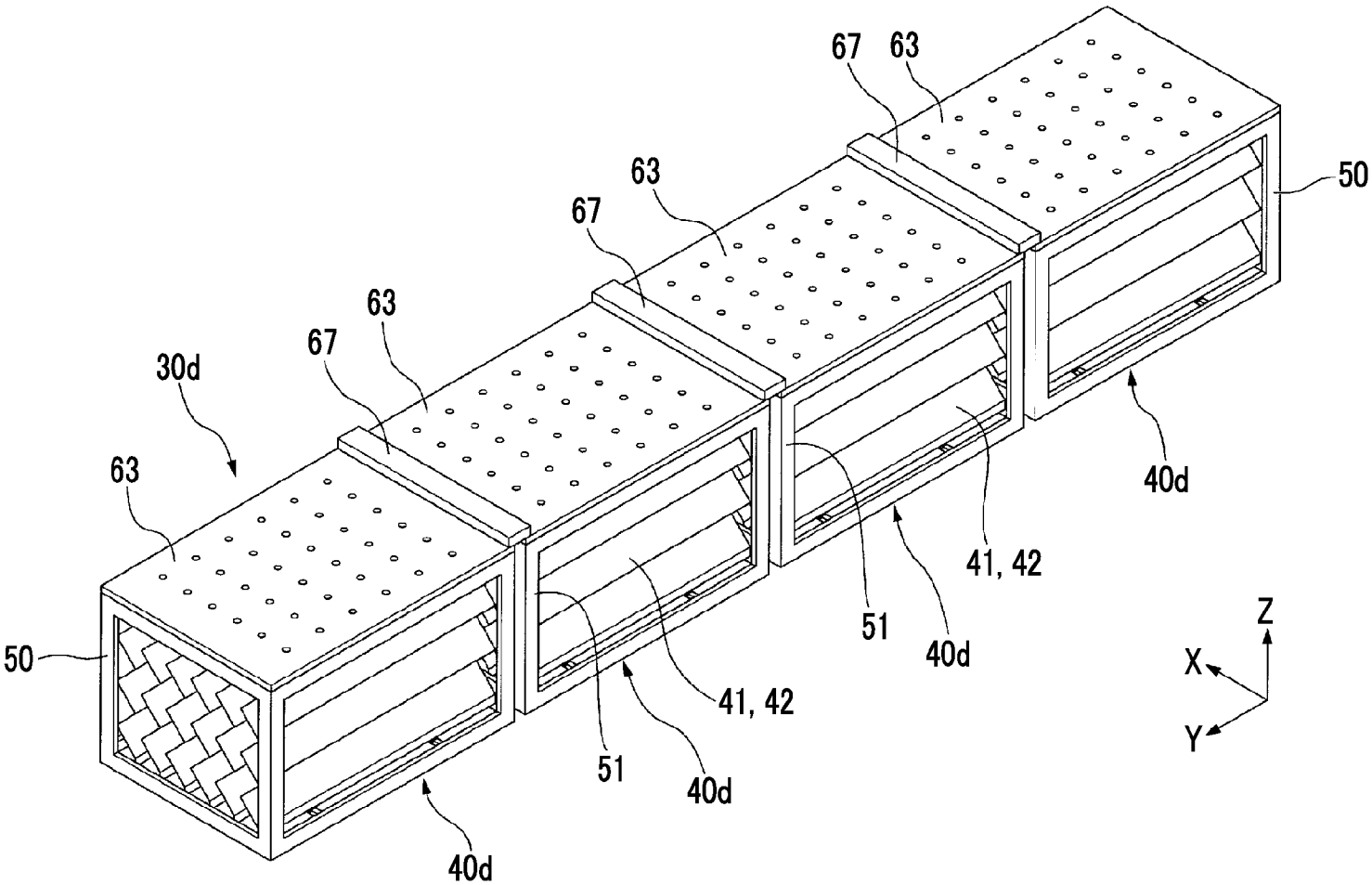
FIG. 10 is a main perspective view showing a reheater according to the fourth modification example of the present invention.

Next, a fourth modification example of the reheater will be described with reference to FIGS. 9 and 10.

A reheater 30*d* of the present modification example includes a plurality of reheating modules 40*d*. In addition, in each of the reheating modules 40*d* of the present modification example, the perforated plate 63 is provided on the upper portion of the frame 50 in the reheating module 40*d*. Similarly to the third modification example, each perforated plate 63 of the plurality of reheating modules 40*d* is joined to partition side plates 24*d* of a pressure bulkhead 22*d*. Accordingly, similarly to the third modification example, the perforated plates 63 of the plurality of reheating modules 40*d* constitute a portion of the pressure bulkhead 22*d* of the low-pressure condenser.

The plurality of reheating modules 40*d* are arranged in the Y direction. Among the plurality of reheating modules 40*d*, two reheating modules 40*d* adjacent in the Y direction are connected to each other by a connector 66 such as a bolt. In addition, the reheater 30*d* of the present modification example includes a water guide member 67 which introduces the low-pressure side condensate reaching the portion between the two adjacent reheating modules 40*d* onto the partition members 41 of one reheating module 40*d*. In the process in which the plurality of reheating modules 40*d* are installed, the water guide member 67 is joined to the end portions in the Y direction of the perforated plate 63, or joined to the connection member 51 positioned at the end in the Y direction among the plurality of connection members 51 configuring the frame 50 of the reheating module 40*d*.

In the present modification example, among the plurality of reheating modules 40*d*, the straightener 31 is provided on the steam upstream side of the reheating module 40*d* that is on the most steam-upstream side. In addition, among the plurality of reheating modules 40*d*, the steam forcible introduction device 32 is provided on the steam downstream side of the reheating module 40*d* that is on the most steam-downstream side.

Thus, as in the present modification example, by appropriately combining the plurality of reheating modules 40*d* prepared in advance, it is possible to easily cope with low-pressure condensers having various sizes. In addition, in the present modification example, the plurality of reheating modules 40*d* are arranged in the Y direction. However, the plurality of reheating modules may be arranged in the X direction, or the plurality of reheating modules may be arranged in the X direction and the Y direction.

Fifth Modification Example of Reheater

Figure 11:
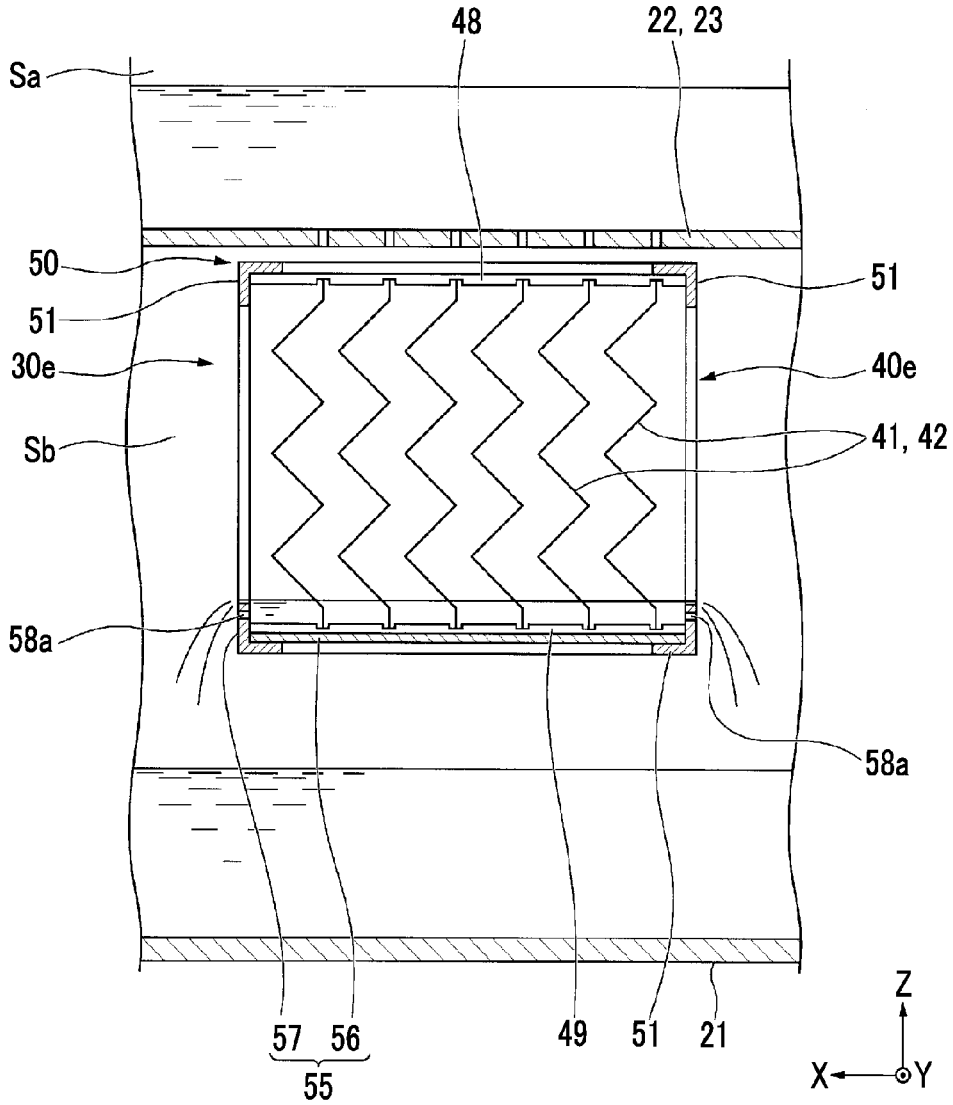
FIG. 11 is a main sectional view of a low-pressure condenser including a reheater according to a fifth modification example of the present invention.

Next, a fifth modification example of the reheater will be described with reference to FIG. 11.

In a reheating module 40*e* of a reheater 30*e* of the present modification example, a plurality of through-holes 58*a* (hereinafter, referred to as dam through-holes 58*a*) are formed in the dam 57 of the reheating module 40 of the above-described embodiment. However, the number of the dam through-holes 58*a* and opening areas of the dam through-holes 58*a* are determined so that the entire flow rate of the low-pressure side condensate flowing out from the plurality of dam through-holes 58*a* is smaller than the minimum flow rate of the low-pressure side condensate flowing from the upper space Sa into the lower space Sb. Accordingly, even when the plurality of dam through-holes 58*a* are formed in the dam 57, the tray 55 is filled with the low-pressure side condensate as long as the low-pressure side condensate flows from the upper space Sa into the lower space Sb.

As described above, if the plurality of dam through-holes 58*a* are formed in the dam 57, since the outflow locations of the low-pressure side condensate flowing out from the tray 55 are distributed, the contact ratio between the low-pressure side condensate and the high-pressure steam increases until the low-pressure side condensate reaches the water collection portion of the lower space Sb. Accordingly, in the present modification example, it is possible to further increase the efficiency of heating the low-pressure side condensate by means of the high-pressure steam.

Sixth Modification Example of Reheater

Figure 12:
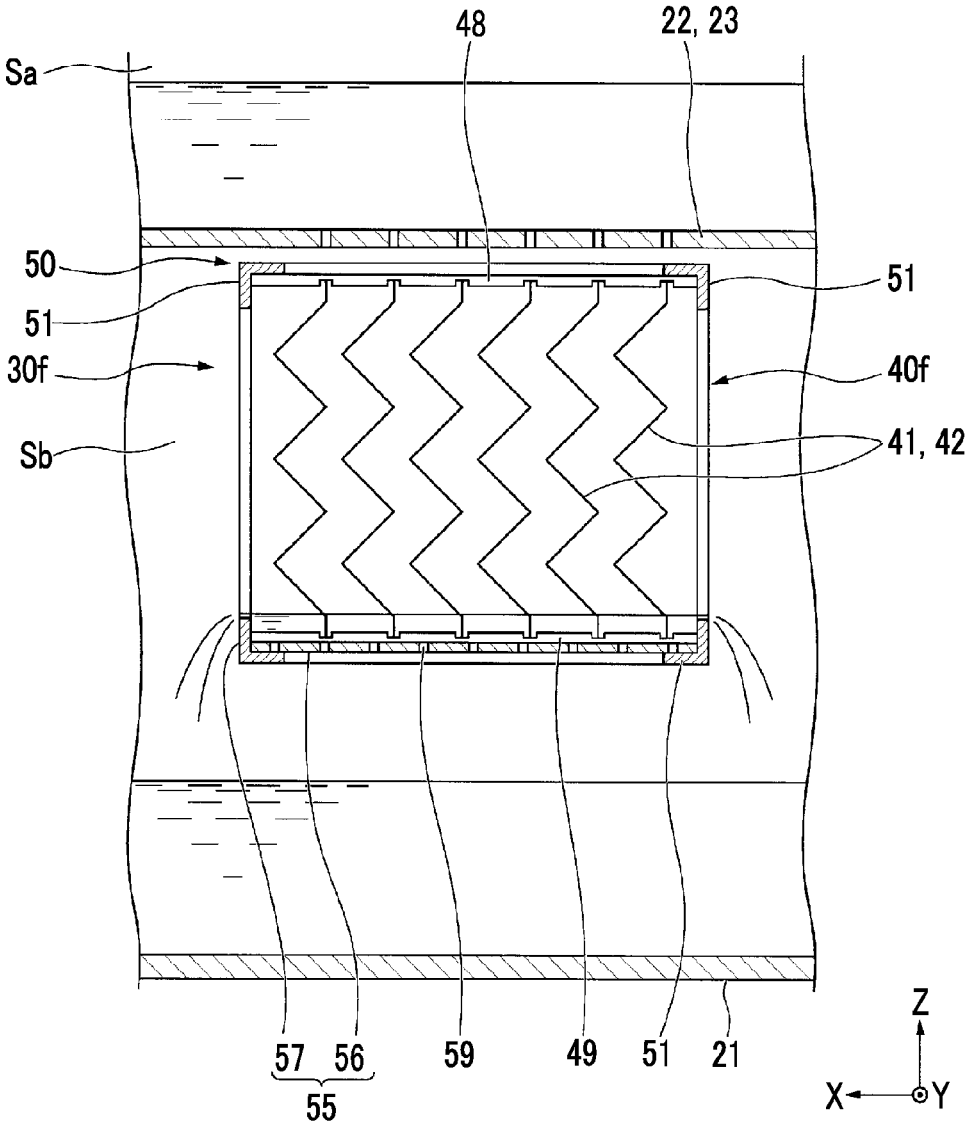
FIG. 12 is a main sectional view of a low-pressure condenser including a reheater according to a sixth modification example of the present invention.

Next, a sixth modification example of the reheater will be described with reference to FIG. 12.

In a reheating module 40*f* of a reheater 30*f* of the present modification example, a plurality of through-holes (hereinafter, referred to as receiving plate through-holes 59) are formed in the receiving plate 56 of the reheating module 40 of the above-described embodiment. However, similarly to the fifth modification example, likewise in the present modification example, the number of the receiving plate through-holes 59 and opening areas of the receiving plate through-holes 59 are determined so that the entire flow rate of the low-pressure side condensate flowing out from the plurality of receiving plate through-holes 59 is smaller than the minimum flow rate of the low-pressure side condensate flowing from the upper space Sa into the lower space Sb. Accordingly, even when the plurality of receiving plate through-holes 59 are formed in the receiving plate 56, the tray 55 is filled with the low-pressure side condensate as long as the low-pressure side condensate flows from the upper space Sa into the lower space Sb.

As described above, similarly to the case where the plurality of dam through-holes 58*a* are formed in the dam 57, also in the case where the plurality of receiving plate through-holes 59 are formed in the receiving plate 56, since the outflow locations of the low-pressure side condensate flowing out from the tray 55 are distributed, the contact ratio between the low-pressure side condensate and the high-pressure steam increases until the low-pressure side condensate reaches the water collection portion of the lower space Sb. Accordingly, likewise in the present modification example, it is possible to further increase the efficiency of heating the low-pressure side condensate by means of the high-pressure steam.

In addition, in the fifth modification example and the sixth modification example, the reheating module 40 of the above-described embodiment is modified. However, in the fifth modification example and the sixth modification example, the reheating modules in the above-described first to fourth modification examples may be similarly modified.

Seventh Modification Example of Reheater

Figure 13:
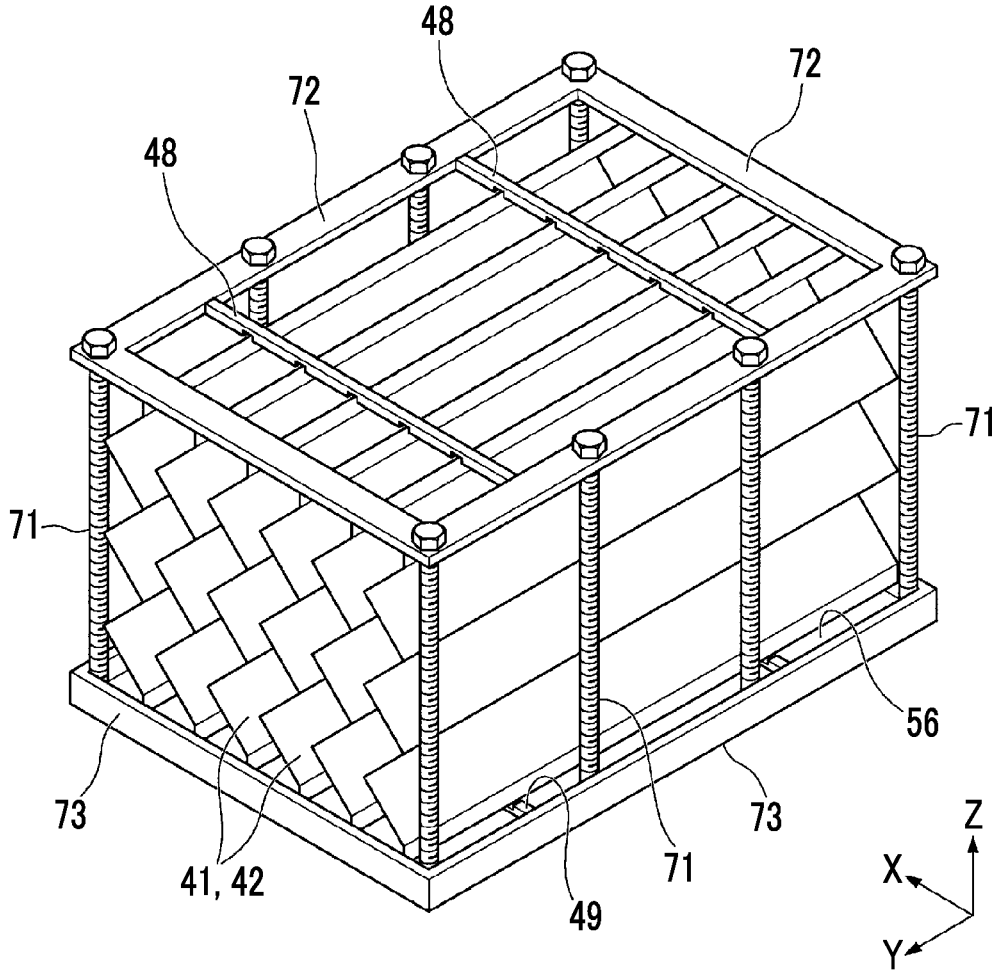
FIG. 13 is a perspective view showing a reheating module adopted in a reheater according to a seventh modification example of the present invention.

Next, a seventh modification example of the repeater will be described with reference to FIG. 13.

In the reheating modules of the above-described embodiment and the above-described modification examples, the plurality of connection members 51 forming the frame are all angle steels. However, the connection members do not have to be angle steels, and may be other shape steels, or may be bar screws 71 as shown in FIG. 13. In addition, the plurality of connection members forming the frame do not have to be all the same in specification, and as shown in FIG. 13, members of various specifications such as the bar screws 71, flat plates 72, and angle steels 73 may be mixed.

First Modification Example of Partition Member

Figure 14:
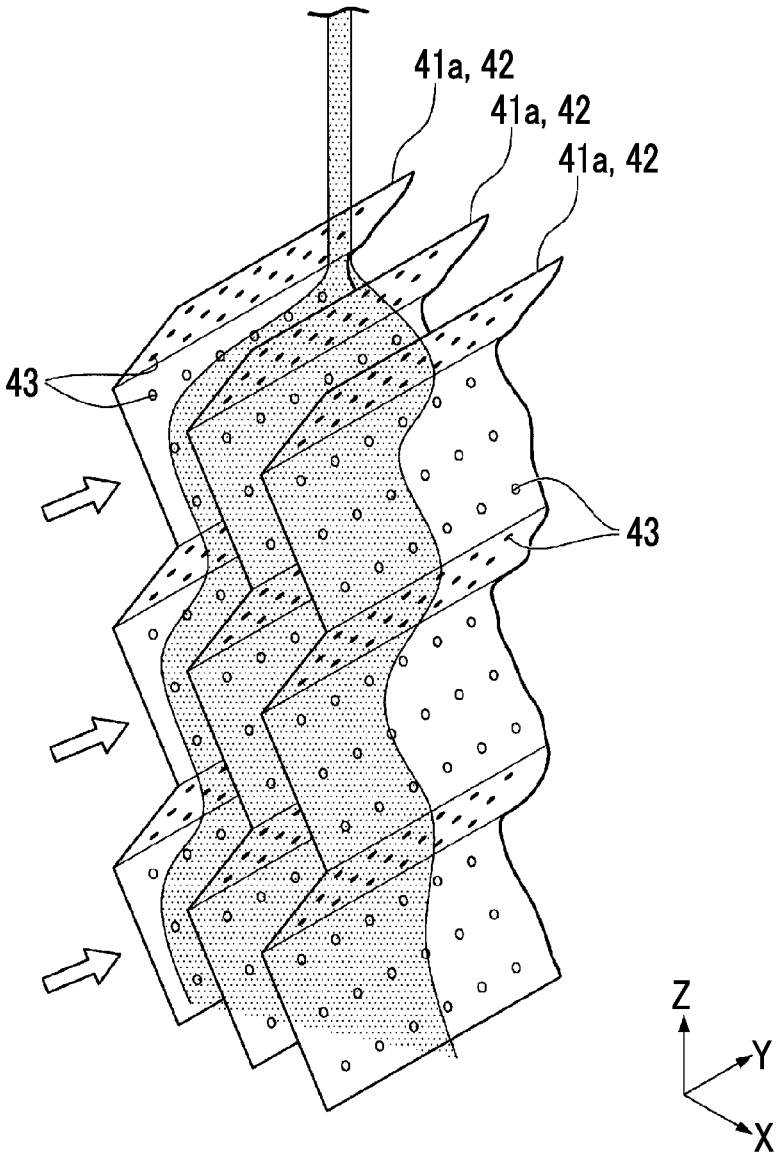
FIG. 14 is a main perspective view showing partition members according to a first modification example of the present invention.

Next, a first modification example of the partition member will be described with reference to FIG. 14.

In partition members 41*a* of the present modification example, a plurality of through-holes 43 (hereinafter, referred to as corrugated plate through-holes 43) are formed in the corrugated plate 42 forming each of the partition members 41 in the above-described embodiment.

In this way, if the plurality of corrugated plate through-holes 43 are formed in the corrugated plate 42, the low-pressure side condensate flows downward along the surface of the corrugated plate 42 and also drops from the corrugated plate through-holes 43. Accordingly, the low-pressure side condensate is distributed, and it is possible to increase the contact ratio between the low-pressure side condensate and the high-pressure steam. Therefore, in the present modification example, it is possible to further increase the efficiency of heating the low-pressure side condensate by means of the high-pressure steam.

Second Modification Example of Partition Member

Figure 15:
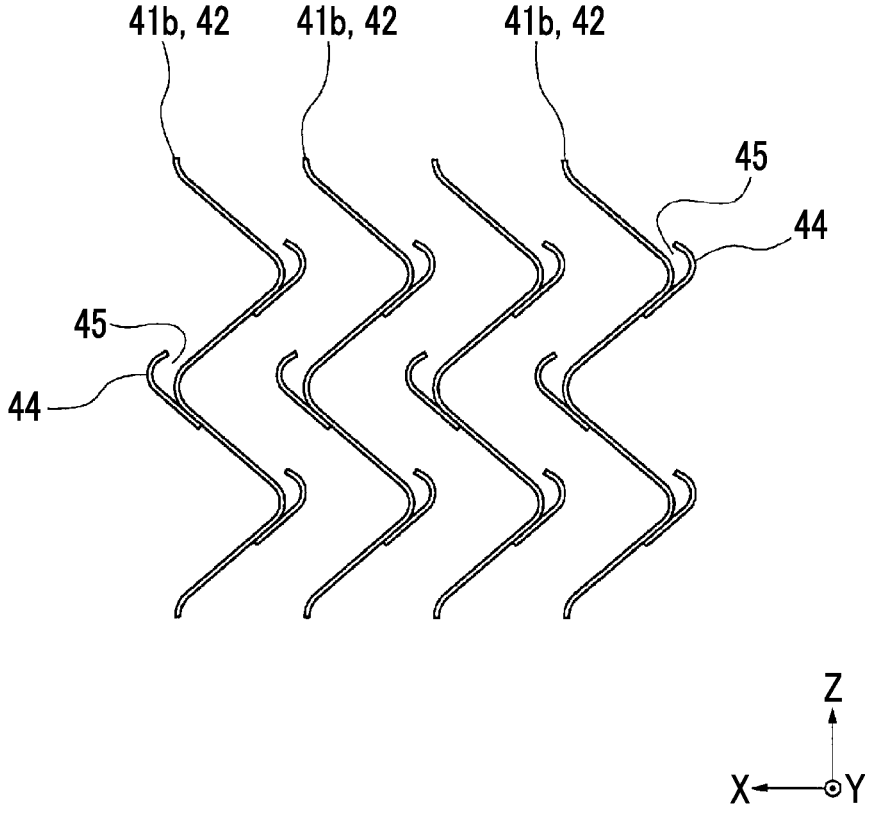
FIG. 15 is a front view showing partition members according to a second modification example of the present invention.

Next, a second modification example of the partition member will be described with reference to FIG. 15.

Partition members 41*b* of the present modification example include the corrugated plates 42 forming the partition members 41 in the above-described embodiment, and a plurality of pocket forming members 44 forming pockets 45 which temporarily collect the low-pressure side condensate in cooperation with the corrugated plates 42.

The low-pressure side condensate flows downward along the surfaces of the corrugated plates 42. In this process, after a portion of the low-pressure side condensate temporarily collects in the pockets 45, the condensate overflows from the pockets 45, and flows downward again along the surfaces of the corrugated plates 42. If the low-pressure side condensate flows into the pockets 45, the low-pressure side condensate collected in the pockets 45 is agitated. Accordingly, the contact ratio between the low-pressure side condensate collected in the pockets 45 and the high-pressure steam increases. Accordingly, likewise in the present modification example, it is possible to further increase the efficiency of heating the low-pressure side condensate by means of the high-pressure steam.

In addition, in the present modification example, the plurality of pocket forming members 44 are provided on the corrugated plates 42 forming the partition members 41 in the above-described embodiment. However, the plurality of pocket members may be provided on the corrugated plates forming the partition members 41*a* in the first modification example. In this way, the partition members do not have to be formed of only the corrugated plates 42, but may use any member as long as it is possible to increase the surface area of the low-pressure side condensate flowing from the upper space Sa into the lower space Sb, and for example, members in which simple flat plates are disposed so as to be inclined may be used.

Modification Example of Steam Forcible Introduction Device

Figure 16:
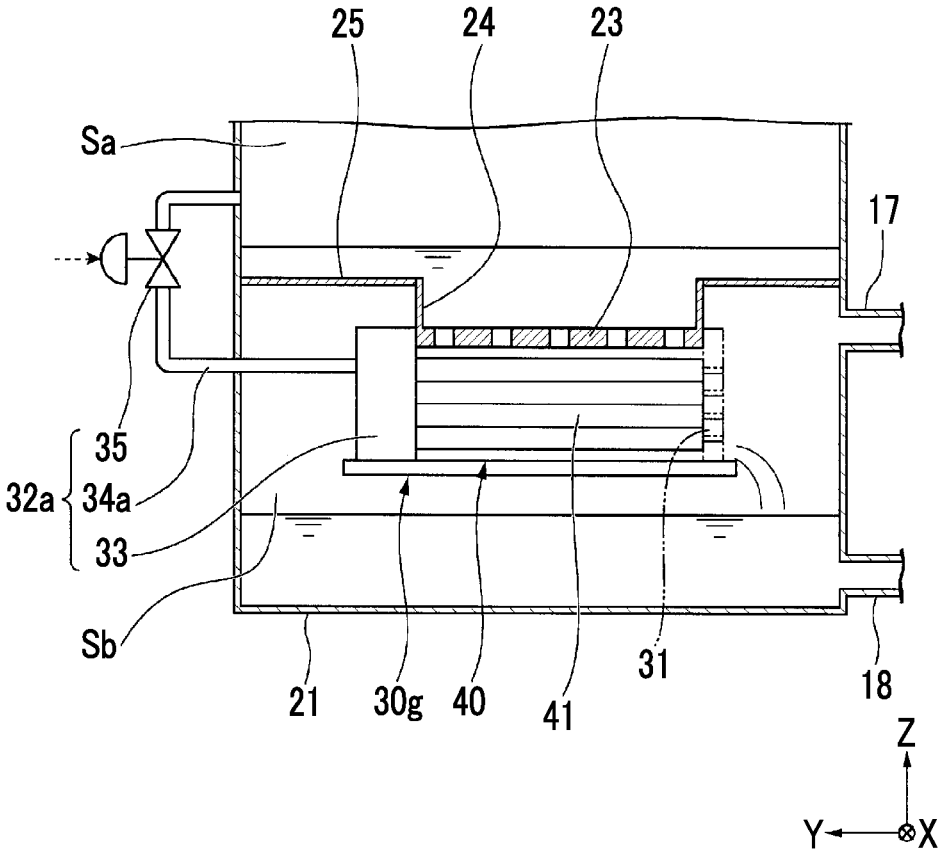
FIG. 16 is a main sectional view of a low-pressure condenser including a steam forcible introduction device according to a modification example of the present invention.

Next, a modification example of the steam forcible introduction device will be described with reference to FIG. 16.

A steam forcible introduction device 32*a* of the present modification example includes the buffer case 33 which covers the downstream side end portion of the reheating module 40, a vent pipe 34*a* which communicates between the inner portion of the buffer case 33 and the upper space Sa, and a flow rate adjustment valve 35 which adjusts a flow rate of gas passing through the vent pipe 34*a*. Unlike the vent pipe 34 of the steam forcible introduction device 32 in the above-described embodiment, after the vent pipe 34*a* penetrates the side wall defining the lower space Sb of the low-pressure condensate container 21 and is temporarily led to the outside of the low-pressure condensate container 21, the vent pipe 34*a* penetrates the side wall defining the upper space Sa of the low-pressure condensate container 21. The flow rate adjustment valve 35 is provided on the portion of the vent pipe 34*a* existing on the outside of the low-pressure condensate container 21.

In the steam forcible introduction device 32*a* in a repeater 30*g* of the present modification example, it is possible to adjust the flow rate of the high-pressure steam passing through the portions between the plurality of partition members 41 by changing a valve opening degree of the flow rate adjustment valve 35. Moreover, in the present modification example, the flow rate adjustment valve 35 is provided to adjust the flow rate of the high-pressure steam. However, instead of this, an orifice may be used.

In addition, in both the above-described embodiment and the present modification example, basically a pressure difference between the spaces is used. However, a fan may be used. For example, the fan may be provided on the upstream side or the downstream side of the reheating module 40, or may be provided in the steam duct 17.

Other Modification Examples

In the above-described embodiment, the pressure bulkhead 22, which partitions the low-pressure condensate container 21 into the upper space Sa and the lower space Sb, has a two-stage configuration in which the pressure bulkhead 22 is divided into upper and lower stages. However, the pressure bulkhead may have a one-stage configuration in a flat plate shape.

In addition, in the multistage pressure condenser of the above-described embodiment, two condensers of the high-pressure condenser 10 and the low-pressure condenser are provided. However, the multistage pressure condenser may include three or more condensers in which the pressures of the saturated steam are different from each other. In this case, with respect to a first condenser in which the pressure of the saturated steam is the highest, a second condenser in which the pressure of the saturated steam is the next highest is set as the low-pressure condenser. In addition, with respect to the second condenser, a third condenser in which the pressure of the saturated steam is the next highest is set as the low-pressure condenser.

INDUSTRIAL APPLICABILITY

According to an aspect of the present invention, it is possible to increase efficiency of reheating condensed water by means of high-temperature steam from the outside.

REFERENCE SIGNS LIST

10: high-pressure condenser, 11: high-pressure condensate container, 16: heat transfer tube, 17: steam duct, 18: condensate flow pipe, 20: low-pressure condenser, 21: low-pressure condensate container, 22, 22*c*, 22*d*: pressure bulkhead, 23: perforated plate, 24: partition side plate, 25: condensate receiving plate, 26: heat transfer tube, 27: bulkhead through-hole, 30, 30*a*, 30*b*, 30*c*, 30*e*, 30*f*, 30*g*: reheater, 31: straightener, 32, 32*a*: steam forcible introduction device, 40, 40*a*, 40*b*, 40*c*, 40*d*, 40*f*: reheating module, 41, 41*a*, 41*b*: partition member, 42: corrugated plate, 43: corrugated plate through-hole, 44: pocket forming member, 45: pocket, 48: upper end support member, 48*a*: upper engagement portion, 49: lower end support member, 49*b*: lower engagement portion, 50: frame, 51: connection member, 55, 55*a*: tray, 56: receiving plate, 57: dam, 58, 59: through-hole, 58*a*: dam through-hole, 59: receiving plate through-hole, 61: side plate, 63: perforated plate, 64: perforated plate through-hole, 67: water guide member

The invention claimed is:

1. A condenser, comprising:

a container into which steam flows;

a pressure bulkhead which partitions the inside of the container into an upper space and a lower space and in which a plurality of bulkhead through-holes are formed;

a heat transfer tube which is disposed in the upper space of the container, and condenses the steam which flows into the upper space; and a reheater which is disposed in the lower space of the container, and which heats water which is condensed from the steam in the upper space of the container and flows into the lower space of the container, by means of high-temperature steam which flows into the lower space from the outside of the container, wherein the reheater includes a plurality of partition members which extend vertically in the lower space of the container and are arranged at intervals from each other, a receiving plate which receives water flowing downward via the plurality of partition members, and a dam which is connected to an outer peripheral edge of the receiving plate and surrounds the receiving plate, and wherein lower ends of the plurality of partition members are below an upper end of the dam.

2. The condenser according to claim 1, wherein a plurality of receiving plate through-holes are formed in the receiving plate.

3. The condenser according to claim 1, wherein a plurality of dam through-holes are formed in the dam.

4. The condenser according to claim 1, wherein the reheater includes side plates which are disposed on both sides of a collection of the plurality of partition members in the direction in which the plurality of partition members are arranged, and oppose each other at intervals from the partition members.

5. The condenser according to claim 1, wherein the reheater includes an upper end support member which supports each upper end portion of the plurality of partition members, and a lower end support member which supports each lower end portion of the plurality of partition members.

6. The condenser according to claim 5, wherein an upper engagement portion, which is recessed from the lower side of the lower space of the container toward the upper side and into which each upper end portion of the plurality of partition members enters, is formed on the upper end support member, wherein a lower engagement portion, which is recessed from the upper side of the lower space of the container toward the lower side and into which each lower end portion of the plurality of partition members enters, is formed on the lower end support member, and wherein, in a state where the partition member is elastically compressed vertically, the upper end portion of the partition member enters into the upper engagement portion of the upper end support member, while the lower end portion of the partition member enters into the lower engagement portion of the lower end support member, and the partition member is interposed between the upper end support member and the lower end support member so as to be supported.

7. The condenser according to claim 1, wherein the partition member includes a corrugated plate in which convex portions protruding in the arrangement direction of the plurality of partition members and concave portions recessed in the arrangement direction are repeatedly formed vertically.

8. The condenser according to claim 7, wherein the partition member includes the corrugated plate, and a plurality of pocket forming members which are open toward the upper side and form pockets for collecting water in cooperation with the corrugated plate.

9. The condenser according to claim 7, wherein a plurality of corrugated plate through-holes are formed in the corrugated plate.

10. The condenser according to claim 5, wherein the reheater includes a reheating module, and wherein the reheating module includes the plurality of partition members, the upper end support member, the lower end support member, the receiving plate, and the dam, and the reheating module includes a connection member which connects the receiving plate, the upper end support member, and the lower end support member with each other and integrates the plurality of partition members, the upper end support member, the lower end support member, the receiving plate, and the dam.

11. The condenser according to claim 10, wherein the reheating module includes a perforated plate which exists in a region vertically above the plurality of partition members and has a plurality of perforated plate through-holes penetrating vertically.

12. The condenser according to claim 11, wherein the perforated plate of the reheating module constitutes a portion of the pressure bulkhead.

13. The condenser according to claim 10, wherein the reheater includes a plurality of the reheating modules.

14. The condenser according to claim 13, wherein the plurality of reheating modules are adjacent to each other, and wherein the reheater includes a water guide member which introduces water reaching a position between the plurality of reheating modules onto the partition member of any reheating module.

15. The condenser according to claim 1, wherein the reheater includes a steam forcible introduction device which forcibly introduces the high-temperature steam into a portion between the plurality of partition members from one side in a steam inflow direction which is perpendicular to the arrangement direction of the plurality of partition members and the vertical direction.

16. The condenser according to claim 1, wherein the reheater includes a straightener which is disposed on one side in the steam inflow direction perpendicular to the arrangement direction of the plurality of partition members and the vertical direction based on the plurality of partition members, orients the flow direction of the high-temperature steam, which flows from the one side into the portions between the plurality of partition members, to the steam inflow direction, and uniformizes flow velocity distribution of the high-temperature steam in a plane perpendicular to the steam inflow direction.

17. A multistage pressure condenser, comprising:

a low-pressure condenser which is the condenser according to claim 1;

a high-pressure condenser in which a pressure of saturated steam generated in a process in which inflow steam is returned to water is higher than a pressure of saturated steam generated in a process in which inflow steam is returned to water in the low-pressure condenser; and a steam duct through which a portion of the steam flowing into the high-pressure condenser flows into the lower space of the low-pressure condenser.

18. A reheating module which heats water flowing from above by means of steam from outside, comprising:

a plurality of partition members which extend vertically and are arranged at intervals from each other;

a receiving plate which receives water dropping via the plurality of partition members;

a dam which is connected to an outer peripheral edge of the receiving plate and surrounds the receiving plate;

an upper end support member which supports each upper end portion of the plurality of partition members;

a lower end support member which supports each lower end portion of the plurality of partition members; and a connection member which connects the receiving plate, the upper end support member, and the lower end support member with each other, and integrates the plurality of partition members, the receiving plate, the dam, the upper end support member, and the lower end support member, wherein lower ends of the plurality of partition members are below an upper end of the dam.

19. The reheating module according to claim 18, further comprising:

side plates which are disposed on both sides of a collection of the plurality of partition members in the direction in which the plurality of partition members are arranged, and oppose each other at intervals from the partition members.

20. The reheating module according to claim 18, further comprising:

a perforated plate which covers a region vertically above the plurality of partition members and the upper end support member, and includes a plurality of vertically penetrating perforated plate through-holes.

* * * * *